US011511178B2

(12) United States Patent
Daniell

(10) Patent No.: US 11,511,178 B2
(45) Date of Patent: Nov. 29, 2022

(54) THRUST-RESPONSIVE SURFACE MATERIAL FOR SKIS

(71) Applicant: Stephen S. Daniell, Lenox, MA (US)

(72) Inventor: Stephen S. Daniell, Lenox, MA (US)

( * ) Notice: Subject to any disclaimer, the term of this patent is extended or adjusted under 35 U.S.C. 154(b) by 0 days.

(21) Appl. No.: 17/319,589

(22) Filed: May 13, 2021

(65) Prior Publication Data

US 2021/0275895 A1 Sep. 9, 2021

Related U.S. Application Data

(63) Continuation of application No. 16/573,720, filed on Sep. 17, 2019, now Pat. No. 11,065,528.

(60) Provisional application No. 62/765,873, filed on Sep. 18, 2018.

(51) Int. Cl.
*A63C 5/00* (2006.01)
*A63C 5/04* (2006.01)

(52) U.S. Cl.
CPC ..... *A63C 5/0428* (2013.01)

(58) Field of Classification Search
CPC ..... A63C 5/0428; A63C 5/00
USPC ..... 280/604
See application file for complete search history.

(56) References Cited

U.S. PATENT DOCUMENTS

| | | | |
|---|---|---|---|
| 476,572 | A | 6/1892 | Stone |
| 1,101,631 | A | 6/1914 | Jacques |
| 1,223,882 | A | 4/1917 | Jacques |
| 1,783,833 | A | 12/1930 | Elsner |
| 2,143,545 | A | 1/1939 | Currier |
| 2,162,888 | A | 6/1939 | Held et al. |
| 2,302,478 | A | 11/1942 | Snow |
| 2,410,702 | A | 11/1946 | Arsenault |
| 2,844,380 | A | 7/1958 | Tribelhorn |
| 3,408,086 | A | 10/1968 | Bennett |
| 3,652,102 | A | 3/1972 | Eaton |
| 3,858,894 | A | 1/1975 | Ver et al. |

(Continued)

FOREIGN PATENT DOCUMENTS

| | | |
|---|---|---|
| AT | 329417 B | 5/1976 |
| AT | 510559 A4 | 5/2012 |

(Continued)

OTHER PUBLICATIONS

International Search Report and Written Opinion from corresponding International Application No. PCT/US2019/051550 dated Nov. 27, 2019.

*Primary Examiner* — James A Shriver, II
*Assistant Examiner* — Hilary L Johns
(74) *Attorney, Agent, or Firm* — Lando & Anastasi, LLP

(57) ABSTRACT

A thrust-responsive structure for skis includes a plurality of retractable elements. Each retractable element includes a portion configured to move from an elevated position to a retracted position. Each retractable element further includes a first retention feature. The structure further comprises a matrix surrounding at least a subset of the plurality of retractable elements. The matrix is static relative to the plurality of retractable elements. The matrix includes a plurality of second retention features configured to captively engage the first retention features of the plurality of retractable elements. A position of each retractable element of the plurality of retractable elements, in the elevated position, is limited by contact between the first retention feature and the second retention feature.

19 Claims, 15 Drawing Sheets

(56) References Cited

U.S. PATENT DOCUMENTS

| | | | | | |
|---|---|---|---|---|---|
| 3,980,312 | A * | 9/1976 | Buttner | A63C 5/044 | 280/610 |
| 4,118,050 | A | 10/1978 | Schnurrenberger | | |
| 4,148,500 | A | 4/1979 | Nidecker | | |
| 4,165,886 | A | 8/1979 | Nussbaumer | | |
| 4,219,214 | A | 8/1980 | Kostov | | |
| 4,223,909 | A | 9/1980 | Danner et al. | | |
| 4,272,577 | A | 6/1981 | Lyng | | |
| 4,320,908 | A | 3/1982 | Ellingson et al. | | |
| 4,398,746 | A | 8/1983 | Heintz | | |
| 4,431,209 | A | 2/1984 | Volkl et al. | | |
| 4,564,210 | A | 1/1986 | Case | | |
| 4,565,387 | A | 1/1986 | Feichtlbauer | | |
| 4,595,215 | A | 6/1986 | Tiitola | | |
| 4,674,764 | A | 6/1987 | Miesen | | |
| 4,690,423 | A | 9/1987 | DeVigili | | |
| 4,714,266 | A | 12/1987 | Feichtlbauer | | |
| 4,717,167 | A | 1/1988 | Adam | | |
| 4,844,500 | A | 7/1989 | Fischer | | |
| 4,919,447 | A | 4/1990 | Jackson et al. | | |
| 5,221,104 | A * | 6/1993 | Bejean | A63C 7/06 | 280/604 |
| 5,344,177 | A * | 9/1994 | Rouser | A63C 5/044 | 280/610 |
| 5,577,754 | A | 11/1996 | Hwu | | |
| 5,727,807 | A * | 3/1998 | Krafft | A63C 5/044 | 280/608 |
| 5,915,717 | A | 6/1999 | Faye | | |
| 6,092,828 | A | 7/2000 | Schumacher | | |
| 6,293,576 | B1 | 9/2001 | Hunter | | |
| 6,367,173 | B2 | 4/2002 | Lancon | | |
| 6,659,492 | B2 * | 12/2003 | Gousie | A63C 5/128 | 280/604 |
| 7,543,839 | B2 * | 6/2009 | Hartmann | A63C 7/04 | 280/604 |
| 7,758,061 | B2 | 7/2010 | Staudinger | | |
| 8,348,299 | B2 | 1/2013 | Ekberg | | |
| 9,027,951 | B2 * | 5/2015 | Holzer | A63C 5/0405 | 280/604 |
| 9,643,075 | B2 | 5/2017 | Brault | | |
| D794,735 | S | 8/2017 | Goldberg | | |
| 9,737,786 | B2 * | 8/2017 | Holovicz | A63C 5/0428 | |
| 10,926,157 | B2 * | 2/2021 | Mayrhofer | A63C 7/08 | |
| 2002/0084624 | A1 * | 7/2002 | Jacobson | A63C 7/06 | 280/604 |
| 2003/0090086 | A1 * | 5/2003 | Gousie | A63C 7/06 | 280/607 |
| 2004/0213960 | A1 * | 10/2004 | Riepler | A63C 7/005 | 428/156 |
| 2006/0186618 | A1 * | 8/2006 | Bregeon | A63C 5/124 | 280/14.21 |
| 2006/0251486 | A1 * | 11/2006 | Schamesberger | A63C 5/044 | 280/601 |
| 2007/0222187 | A1 * | 9/2007 | Staudinger | A63C 5/0428 | 280/601 |
| 2010/0194075 | A1 | 8/2010 | Zemp | | |
| 2011/0193322 | A1 * | 8/2011 | Holzer | A63C 5/0428 | 280/609 |
| 2011/0278824 | A1 | 11/2011 | Popel | | |
| 2016/0045813 | A1 * | 2/2016 | Mayrhofer | A63C 7/02 | 156/60 |
| 2018/0078844 | A1 * | 3/2018 | Nobil | A63C 7/08 | |
| 2018/0250579 | A1 | 9/2018 | Mayrhofer et al. | | |
| 2020/0086201 | A1 | 3/2020 | Daniell | | |

FOREIGN PATENT DOCUMENTS

| | | | | |
|---|---|---|---|---|
| CH | 133498 | A | 6/1929 | |
| CH | 134396 | A | 7/1929 | |
| CH | 187456 | A | 11/1936 | |
| CH | 212132 | A | 10/1940 | |
| CH | 219054 | A | 1/1942 | |
| CH | 223797 | A | 10/1942 | |
| CH | 234813 | A | 10/1944 | |
| CH | 340748 | A | 8/1959 | |
| CH | 604770 | A5 | 9/1978 | |
| CH | 614860 | A5 | 12/1979 | |
| CH | 674946 | A5 | 8/1990 | |
| DE | 720609 | C | 5/1942 | |
| DE | 870369 | C | 3/1953 | |
| DE | 1075998 | B | 2/1960 | |
| DE | 1149653 | B | 5/1963 | |
| DE | 7316840 | U | 9/1973 | |
| DE | 2346235 | A1 | 3/1975 | |
| DE | 2402791 | A1 | 7/1975 | |
| DE | 2724711 | A1 | 9/1978 | |
| DE | 2732091 | A1 | 2/1979 | |
| DE | 2949688 | A1 | 6/1981 | |
| DE | 3045853 | A1 | 6/1982 | |
| DE | 3117818 | A1 * | 12/1982 | |
| DE | 3117818 | A1 | 12/1982 | |
| DE | 3324983 | A1 | 5/1984 | |
| DE | 3344641 | A1 | 7/1984 | |
| DE | 3303093 | A1 | 8/1984 | |
| DE | 4012348 | A1 | 10/1990 | |
| DE | 202012000236 | U1 | 2/2012 | |
| EP | 0193080 | A2 | 9/1986 | |
| EP | 2452729 | A1 | 5/2012 | |
| EP | 2452729 | B1 | 10/2016 | |
| EP | 3013443 | B1 | 5/2017 | |
| EP | 3060321 | B1 | 5/2017 | |
| ES | 2400896 | A1 | 4/2013 | |
| FR | 742168 | A | 2/1933 | |
| FR | 782719 | A | 6/1935 | |
| FR | 848556 | A | 11/1939 | |
| FR | 915862 | A | 11/1946 | |
| FR | 1110207 | A | 2/1956 | |
| FR | 1170272 | A | 1/1959 | |
| FR | 2213076 | A1 | 8/1974 | |
| FR | 2234909 | A1 | 1/1975 | |
| FR | 2269358 | A1 | 11/1975 | |
| FR | 2307559 | A1 | 11/1976 | |
| FR | 2404445 | A1 | 4/1979 | |
| FR | 2482464 | A1 | 11/1981 | |
| FR | 2497459 | A1 | 7/1982 | |
| FR | 2613242 | A1 | 10/1988 | |
| FR | 2643565 | A1 | 8/1990 | |
| FR | 2899819 | A1 | 10/2007 | |
| JP | S53735 | A | 1/1978 | |
| WO | 9324192 | A1 | 12/1993 | |
| WO | 2004064949 | A1 | 8/2004 | |
| WO | 2007003014 | A1 | 1/2007 | |
| WO | WO-2007003014 | A1 * | 1/2007 | A63C 7/08 |
| WO | 2010063246 | A2 | 6/2010 | |
| WO | 2012102549 | A2 | 8/2012 | |
| WO | 2014118399 | A1 | 8/2014 | |
| WO | 2014205472 | A1 | 12/2014 | |
| WO | 2016118999 | A1 | 8/2016 | |

* cited by examiner

Fig. 5
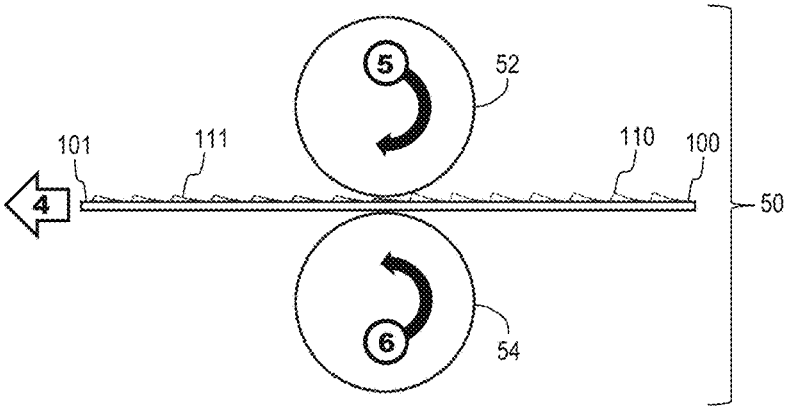
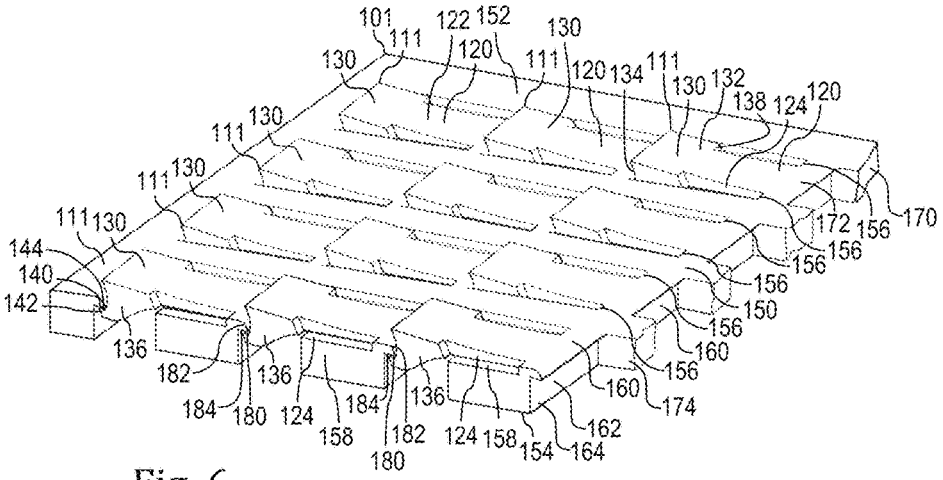
Fig. 6
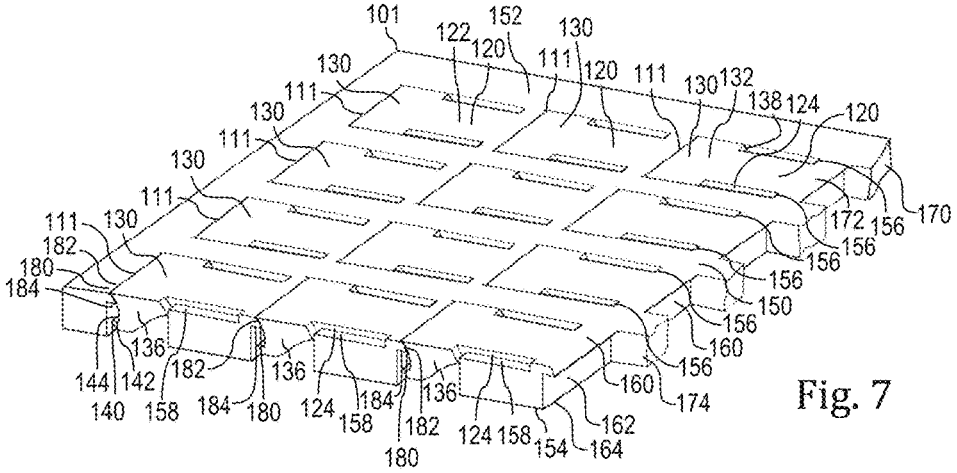
Fig. 7

THRUST-RESPONSIVE SURFACE MATERIAL FOR SKIS

CROSS-REFERENCE TO RELATED APPLICATIONS

This application is a continuation of U.S. patent application Ser. No. 16/573,720 filed Sep. 17, 2019, titled THRUST-RESPONSIVE SURFACE MATERIAL FOR SKIS, which claims priority to U.S. Provisional Patent Application Ser. No. 62/765,873 filed Sep. 18, 2018, titled THRUST-RESPONSIVE SURFACE MATERIAL FOR SKIS, each of which is incorporated by reference herein in its entirety.

BACKGROUND OF THE DISCLOSURE

1. Field of the Disclosure

The disclosure relates to the practice of skiing. It particularly relates to Nordic skiing, cross-country skiing, backcountry skiing, telemark skiing, alpine touring (A/T) skiing, and novice skiing. Certain modular embodiments of the disclosure are applicable where variable snow conditions and diverse terrain are routinely encountered. The disclosure is also generally useful as a self-activating control device to enable climbing or prevent backsliding, while enabling unimpeded downhill skiing.

2. Discussion of Related Art

Skiing forward on level or inclined terrain on a pair of skis requires a combination of equipment and technique. A ski that has no asymmetry of structure or operation cannot propel the skier preferentially in one direction or another. Forward motion is therefore imparted either by skating, by sliding, by poling with the arms, or by a conscientiously applied combination of such directional forces.

When sliding forward on level or inclined terrain, the skier commonly keeps the skis parallel and uses a complementary poling action. The process of making efficient forward progress on skis requires both that the skier first push against from the snow-covered surface, and then glide forward upon it, in an alternating manner.

This practice demands opposing qualities of the ski base that is in contact with the snow, as the ski is ideally kept stationary relative to the terrain during the push phase, yet should encounter minimal resistance during the subsequent sliding action.

This tradeoff in the property of the base material is sometimes known as "grip vs. glide." The present disclosure is directed to minimizing this tradeoff through the use of a surface that configures its relief texture depending upon the axial orientation of an applied force.

The optimal property of the ski while the skier is in the pushing phase is one of high friction, engagement, or resistance between the ski's bottom face and the snow surface. The optimal property of a ski while the skier is in the gliding phase is one of low friction, low engagement, and low resistance between the ski's bottom face and the snow surface. Some known approaches include diverse attempts to preferentially promote forward advancement, or deter rearward motion by the skier.

Some historical solutions have been directed to added safety to the skier through the deterrence of accidental backsliding when the skier is holding a static pose. In such circumstances, the initiation of unexpected rearward motion might cause the skier to lose control, fall, collide, or encounter diverse ambient physical hazards.

Some known approaches also illustrate a structural bias introduced to preferentially promote a forward skiing motion. Historically, there are three main classes of solutions providing a functional bias toward forward motion.

The first class of designs is some arrangement of a wax, or a variety of waxes, upon the bottom of the skis. The second is some sort of formed or molded relief having asymmetric frictional properties. In this second class, a corrugated or imbricated pattern is commonly molded into the bottom of the ski. The third class includes the temporary or permanent attachment, in the central region of the ski base, of strips of filamentous fabric devised to exhibit a strong directional bias. These last two classes are sometimes denoted as "waxless skis."

In competitive Nordic skiing, waxless skis are widely regarded as providing inferior performance to professionally-prepared waxed skis. However, waxless skis are far more convenient and less costly to maintain than skis that require the application of waxes.

A type of waxless material typically uses a "fish-scaled," serrated, convoluted or imbricated relief pattern to impart a degree of forward travel bias. A relief feature with more angular inclination in its pattern provides better grip as the skier pushes forward against a snow-covered surface. However, greater inclination of relief features has the countervailing effect of interfering with extent and duration of the gliding phase.

A ski base with surface features having more modest slope provides better gliding as the skier pushes off, however, this modification invites slippage as the skier attempts to propel forward by bearing against the surface of the snow. It is recognized, in the practice of ski design, that this tradeoff is inherent in all skis of this general class.

Alternatively, in another class of designs, an area of textured fabric may be located substantially beneath the region where the boot is located on the ski. In modern implementations, the textured material be made of a molded polymer material, or may be woven, in either case using a synthetic material imitating the historic use of mammal skin. In both the natural or synthetic materials, the fibers are typically laid flat, and oriented toward the rear of the ski in parallel alignment with the ski's long axis.

A filamentous surface provided by strips of artificial sealskin provides an analogous effect, but also yields similar compromises. Threads or filaments are laid down axially so that the material has an asymmetric effect upon engagement with a snow surface.

However, this filamentous class of material has the same intrinsic limitation that imbricated patterns impose, namely, that there is a tradeoff between the persistent slope of the features and their frictional effect at relevant phases of the skiing action.

There have been a variety of supplementary historical efforts directed to overcoming the limitations of variable snow conditions, diverse terrain, and the contradictory frictional demands of the complex motions of a skier. These include removable or electively activated components that engage aggressively with snow or ice.

For example, there are detachable skins or cleats devised to aid skiers engaged in extended climbing. There are also pre-attached mechanisms, often toothed or textured, which can be actively engaged by the skier to grip the snow during climbing or decent. Some known mechanisms have been devised to be intermittently activated by a lever or a linkage to the boot's binding.

SUMMARY OF THE DISCLOSURE

The present disclosure proposes the fabrication of a periodic, structured material whose mechanical resistance changes relative to snow-covered terrain depending upon the axis of applied thrust. The change in mechanical resistance activated by the alternation in direction of muscular force of applied by the skier. This force is transferred through the boot, to the skis, and ultimately to the interface between the bottom of the ski and the surface of the snow.

In the disclosure, the self-configuring property is obtained by the conscientious design of a complex molded polymer material encompassing an array of integrally molded teeth. The teeth are molded in such a way that, after molding, they can be displaced into an alternate position, and permanently engaged with a surrounding lattice.

The following description explains ways in which the novel base component can be obtained in a monolithic structure, namely, within a part manufactured in a single molding operation. Once set in place, the teeth are held in a normally raised position by spring force intrinsically applied between two opposed retention features. According to the teachings of the disclosure, a robust part, having an array of moveable but delimited tooth components, can be inexpensively formed and installed in the base of a ski.

In illustrated embodiments of the disclosure, the relationship of the retention features resembles a mutually opposed snap fitting. In broad, general practice of snap fitting design, at least one entry face is sloped or radiused to ease mutual engagement of the fittings.

However, while this practice is enacted within certain applications within this disclosure, embodiments described herein allow for the conscientious, transient deformation of regions of the part in such a way that the passage of the features into an engaged relationship is actively facilitated by an installation tool or device. The tool may be an existing workshop tool, or may be an expressly-fabricated piece of equipment. The tool or device may be operated manually, or automated to various degrees, according to the circumstances of the parts' production.

This understanding permits freedom in the design of parts formed within the embodiments described herein, as the forces and directions of the contact surfaces of the engaging elements are not the sole mechanical parameters considered in the structural engagement of the spring-loaded teeth within their support structure.

It should be broadly understood, nevertheless, that the retention faces of a snap fitting may be given a slope within a range of face angles, in order to electively and variably promote or prevent intermittent release and removal of attachable components.

In the present disclosure, it is generally desired that the teeth remain in place and remain mechanically limited within the array for the duration of their operational life. Therefore, the retentive face angles are generally devised, to the extent it is permitted by mold design, to interfere with forces that might result in the reversal of the mechanical engagement process.

Contact faces in the mechanically altered elements are therefore devised to be substantially perpendicular to the direction of forces applied by each flexed tooth beam. Indeed, in certain mold designs illustrated in this specification, the hook angle of the engaged tooth can exceed perpendicularity, to such an extent that the teeth may be disengaged from their support matrix only through the use of destructive force.

By this structural arrangement, the part geometry ensures that the engaged elements will maximally resist forces imparted by a given human user during skiing activity, because the array of snap-fittings acts as a reliable and durable limitation on the angular motion of the teeth.

That angular motion includes the raising and lowering of the teeth in response to alternately applied external forces. Within the disclosure, the angular motion also provides each tooth with a self-cleaning action, as each tooth is essentially retracted into a close-fitting recess with each alternation of the active thrust axis.

Accordingly, illustrated embodiments of the disclosure are devised to exclude ice or snow, as the gaps surrounding the tooth can be considerably smaller than the typical dimension of crystalized snow particles. Any snow momentarily binding to a given tooth is released from the ski base when the tooth lowers into its corresponding recess. Additional, or alternate, resilient features may be devised to exclude or eject snow or ice from under or around the teeth, and tooth spacing within the matrix may be adjusted accordingly.

Embodiments of the present disclosure therefore allow the easy and natural forward impulse of the skier, while providing an exceptional reduction of drag during the coasting phases of the skier's actions. Within the disclosure, a reduction of mechanical resistance is encountered while skiing in an alternating motion, whether on relatively level topography, or on uphill terrain. Furthermore, since the ski base lies smooth while in forward motion, the disclosure also provides reduced resistance during gravity-assisted downhill skiing relative to other available off-slope ski technologies.

More specifically, when the skier moves the ski forward through muscular action, or through the gravitational exploitation of a declivity of terrain, the teeth are pressed flush with the bottom of the ski, and remain flush as long as the ski rides forward upon the snow.

When the skier stops or applies rearward force again, the teeth extend, causing the ski to grip the snow-covered surface. It may be appreciated that this alternating, passive structural change provides a greatly enhanced and useful forward bias in the skier's direction of travel.

The proposed disclosure therefore provides significant advantages over the existing commercially available methods of using waxes, synthetic skins, or imbricated plastic laminations. None of these historical practices provides a differentially operable surface relief whose active mechanical structure and performance is strongly dependent upon the direction of thrust.

Furthermore, the disclosure enables a range of materials that may be adapted to particular skill levels, terrain conditions, prevailing weather, compatible ski designs, ski event parameters, individual habits, or particular weight distributions in conjunction with a predetermined ski design. The disclosure expressly includes applications in which the mechanical or material properties of interchangeable components provide a range of electable performance attributes.

The present disclosure demonstrates that, by consistent dimensioning and compatible design of attachment features, diverse components within the scope of the disclosure are made interchangeable upon the base of the ski. A skier may therefore conveniently modify the ski is such a way that its operation is optimal for the prevailing circumstances.

It may be appreciated that this minimizes the cost of safe and successful participation in the sport, as a single pair of skis may be intermittently and inexpensively outfitted for a range of operational conditions. Indeed, different components may be interchanged within a single outing, since variables such as weather, terrain, or the degree of the user's remaining athletic vigor may change in the course of the event.

In the following illustrations and descriptions, it may furthermore be appreciated that materials proposed within the disclosure can provide novel benefits both to the novice and to the expert skier.

The thrust-responsive quality of the materials of the disclosure makes reliable forward motion more readily attainable to the novice, while the same adaptive property provides a performance advantage to the competitive or advanced skier encountering complex or varied terrain.

Material formed in accordance with the disclosure also provides general advantages when the skier is presented with an ascending inclination, while self-configuring to provide reduced resistance whenever the skier is moving downhill. Accordingly, embodiments of the disclosure may foreseeably be employed in preference over the labor-intensive installation and removal of accessory devices, such as adhesive-backed filamentous climbing skins.

One aspect of the present disclosure is directed to a thrust-responsive structure for skis. In one embodiment, the structure comprises a plurality of retractable elements. Each retractable element includes a portion configured to move from an elevated position to a retracted position. Each retractable element further includes a first retention feature. The structure further comprises a matrix surrounding at least a subset of the plurality of retractable elements. The matrix is static relative to the plurality of retractable elements. The matrix includes a plurality of second retention features configured to captively engage the first retention features of the plurality of retractable elements. A position of each retractable element of the plurality of retractable elements, in the elevated position, is limited by contact between the first retention feature and the second retention feature.

Embodiments of the structure further may include forming the plurality of retractable elements monolithically. The plurality of retractable elements may be formed monolithically with the matrix. The first retention features of the plurality of retractable elements may be formed monolithically with the plurality of second retention features of the matrix. The structure further may include a cover plate including a plurality of apertures and a lattice defined by the plurality of apertures. The cover plate may be formed separately from the matrix, with the cover plate functionally encompassing the plurality of second retention features of the matrix. Each retention feature of the first retention features of the plurality of retractable elements and the plurality of second retention features of the matrix may be compatibly dimensioned mating components configured to snap fit with one another. The plurality of retractable elements may be pliably hinged to the matrix. The plurality of retractable elements may be monolithically hinged to the matrix. Each retractable element among the plurality of retractable elements may be received in a recess formed in the matrix, with the recess being commensurately configured to receive the retractable element therein. Each retractable element of the plurality of retractable elements and the recesses of the matrix may be companionably devised so that an external face on each retractable element, when retracted, substantially occupies the same geometrical plane as the matrix. Each retractable element of the plurality of retractable elements may be held by default in the elevated position by at least one pliable feature. The at least one pliable feature may be a spring. The spring may be formed monolithically with a corresponding retractable element from among the plurality of retractable elements. The at least one pliable feature may be composed of a resilient material. The structure further may include a control plate. The control plate may include a plurality of engagement features configured to be deliberately devised to interactively intrude upon a free range of motion of the retractable elements, and thereby regulate the position of the retractable elements.

Another aspect of the disclosure is directed to a ski equipped to be biased to forward motion. In one embodiment, the ski comprises a ski body including a recess. The recess is formed in the bottom of the ski body. The ski further comprises an array of retractable elements pliably coupled to a matrix. The matrix remains substantially static relative to the array of retractable elements. The ski further comprises fastening means to interchangeably attach the matrix to the recess in the ski body.

Embodiments of the ski further may include configuring the array of retractable elements with a plurality of retractable elements. Each retractable element may include a portion configured to move from an elevated position to a retracted position, with each retractable element further including a first retention feature. The matrix may be configured to surround at least a subset of the plurality of retractable elements. The matrix may be static relative to the plurality of retractable elements, with the matrix including a plurality of second retention features configured to captively engage the first retention features of the plurality of retractable elements. Each retractable element of the plurality of retractable elements, in the elevated position, may be limited by contact between the first retention feature and the second retention feature.

Yet another aspect of the present disclosure is directed to a method of forming a resilient structure, without preference for order or simultaneity. In one embodiment, the method comprises: forming an array of monolithically interconnected retractable members having mechanical engagement means formed thereon; forming a matrix having mechanical engagement means thereon, the matrix being formed monolithically with the array of monolithically interconnected retractable members; subjecting the array to mechanical force sufficient to structurally engage at least a portion of the monolithically interconnected retractable members with the matrix having mechanical engagement means thereon. A positional extent of the retractable members is thereafter limited by a mutual obstruction between the mechanical engagement means formed on the monolithically interconnected retractable members and the mechanical engagement means formed on the matrix.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 5 is a schematic elevation view of the agile traction component being mechanically processed through a pair of rollers to permanently engage its teeth with its surrounding matrix;

FIG. 6 is a is a partially cut away perspective view of the traction component of FIG. 4, subsequent to the mechanical engagement of the teeth, showing the teeth in their default extended position;

FIG. 7 is a is a partially cut away perspective view of the traction component of FIG. 4, subsequent to the mechanical engagement of the teeth, showing the teeth in their flush, retracted position, as when the force of snow-covered terrain is being applied to the component;

Further understandings of the disclosure may be gained by reference to the above-listed drawings in coordination with the following detailed descriptions.

DETAILED DESCRIPTION OF THE DISCLOSURE

The disclosure describes various ways of applying a passively-activated, intermittently textured material to the base of a ski. An intermittently textured material is one which possesses a functional relief in one mode of operation, but becomes effectively flat in another phase of operation. In the present examples, the material therefore naturally toggles between a state where it glides easily across the snow, and one in which it grips the snow firmly and preferentially promotes forward travel and deters backsliding.

The phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated references is supplementary to that of this document; for irreconcilable inconsistencies, the term usage in this document controls.

Figure 1:
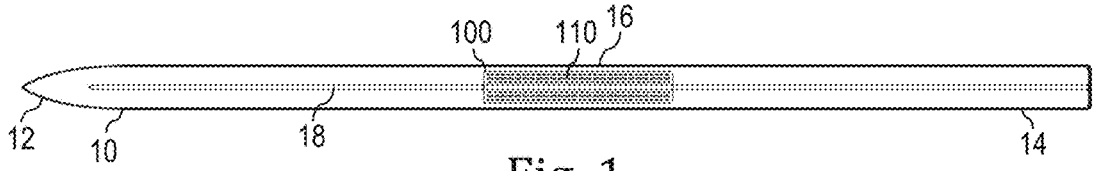
FIG. 1 is a schematic bottom view of a ski formed according to the disclosure.

FIG. 1 shows a schematic bottom view of traction ski 10 formed according to the disclosure. Skis devised, modified, or elected for use within the disclosure can take many forms. They may vary by the shape or composition of the core, the tip, waist and tail, the core, the deck, the sidecut, the camber and rocker, the base, or special provisions for mounting boots, other gear, or accessories.

Traction ski 10 includes traction ski tip 12, traction ski tail 14, cambered kick zone 16, and traction ski tracking channel 18. Cambered kick zone 16 lies between recurved ski tip 12 and recurved traction ski tail 14. The degree of camber is usually matched to the body weight of the skier, so that the ski bends into weighted contact with the snow when the skier's weight is momentarily placed directly over this zone. Ski tracking channel 18 preferentially encourages linear motion, and discourages unwanted side-slipping.

In this embodiment of the disclosure, thrust-adaptive relief module 100 is mounted in cambered kick zone 16, and includes a plurality of extensible teeth 110 that are passively extended or retracted by the athletic action of the skier upon and against snow-covered terrain.

Figure 2:
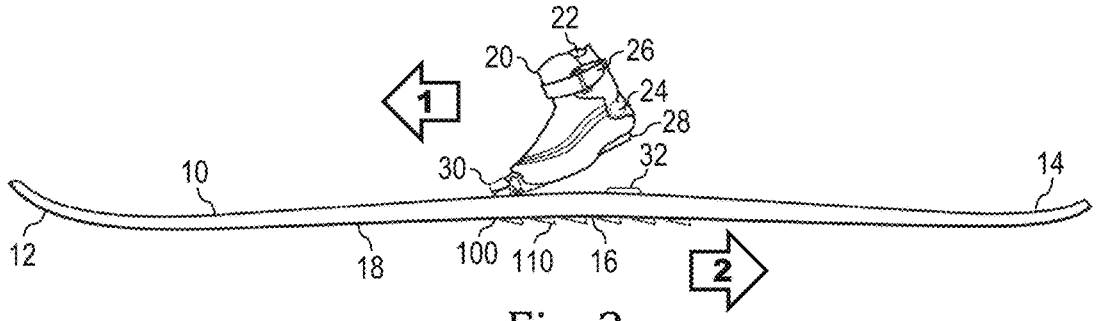
FIG. 2 schematic side view of ski formed according to the disclosure, in grip mode.
Figure 3:
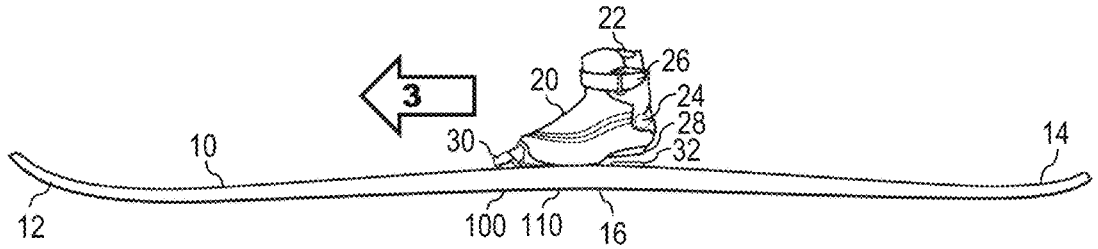
FIG. 3 schematic side view of ski formed according to the disclosure, in glide mode.

FIGS. 2 and 3 show exemplary ski boot 20 releaseably attached to toe binding 30 and resting on heel plate 32. Ski boot 20 includes foot recess 22, into which the foot of the skier is inserted. Ski boot 20 also includes ankle hinge 24, ski boot closure 26, and ski boot heel support 28. Such boots are generally devised to provide both structural bracing and comfortable articulation to the skier's foot.

Toe binding 30 is fixedly attached to ski 10, however, as is known in certain relevant practices of skiing, toe binding 30 is designed to permit a sufficient degree of angular motion that the heel of the boot may be electively lifted from the heel plate by the skier. Such angular freedom is commonly permitted by resilient or hinged components, or a combination thereof, and allows the skier's muscular action to impart cyclical impulses of forward motion.

It should be noted that while some equipment always leaves the heel free, a subset of bindings includes a secondary binding component at the back of the shod foot, which allows a skier to electively lock the heel of the boot in place. This option is usually engaged when an extended session of downhill skiing is expected. In conventional Alpine skiing, the heel is always secured.

Returning to the drawings, the underside of ski tip 12 is formed continuously with ski base 14, which terminates at ski tail 16. Ski 10 can be of diverse design, and may be an assembly including strips, rods, hollows, edges, sheets, membranes, fabrics, fibers, foams, lattices, or honeycombs. Ski materials may include wood, metal, glass, carbon, polymers, adhesives, or composites.

FIGS. 1 through 3 inclusive schematically depict thrust-adaptive relief module 100 mounted on a region of the underside of ski 10. The region beneath and just behind the boot is colloquially known as the kick zone. In the exemplary illustrations, thrust-adaptive relief module 100 is mounted in cambered kick zone 16.

However, as the disclosure may be adapted to various skiing operations, the diverse requirements of these operations may promote or obligate placements of components formed according to the disclosure elsewhere on the ski.

FIG. 1 shows extensible teeth 110 included on the external face of thrust-adaptive relief module 100. The side view in FIG. 2 shows extensible teeth 110 schematically extended from thrust-adaptive relief module 100. The side view in FIG. 3 shows extensible teeth 110 in their alternate position, namely, invisibly retracted within thrust-adaptive relief module 100.

The exemplary operation of the disclosure may be understood by reference to FIGS. 2 and 3. The direction of desired travel is indicated by directional arrow 1 in the figure. In a typical skiing action, muscular force is applied via the mounted boot to impel the ski in a rearward direction, as indicated by directional arrow 2. In an ideal scenario, the ski would remain stationary, and the skier propelled forward by the full force of the rearward thrust imparted between the ski's base and the snow-covered terrain.

It may be appreciated by particular reference to FIG. 2 that the extension of the teeth, and their mechanical engagement with the snow layer, would increase the reaction force, and propel the skier aggressively forward. However, were the teeth to remain in their raised position, the benefit of the increased purchase would almost immediately be lost, owing to the drag imparted by the raised, coarsely textured array.

FIG. 3 schematically depicts the self-configuring nature of tooth arrays formed in accordance with teachings of the present disclosure. During the relative sliding motion between the ski base and the snow layer, the skier's weight is placed directly over the kick zone as the ski slides forward. The combination of weight distribution and forward motion imparts a force countering the default spring force keeping the teeth in a normally extended position.

These combined forces therefore induce the array of teeth to retract and become momentarily flush with the base of the ski. The retraction permits the ski to glide forward with a reduced degree of resistance that differs little from a ski outfitted with a plain base. The resulting long, unimpeded gliding stroke is indicated by directional arrow 3.

It may be appreciated that the self-actuating property of the toothed component relieves the ski equipment, and the skier, of the direct tradeoff between grip and glide. Accordingly, forward progress on skis is naturally and efficiently achieved.

FIGS. 4 through 7 inclusive show structural details of exemplary thrust-adaptive relief module 100. A challenge in prior attempts to form an adaptive thrust system has been the difficulty in limiting the outward motion of any raised features. Another challenge has been providing a structure that permits sufficiently free and unimpeded cyclical displacement of relief elements.

The present disclosure specifies how a monolithic array of teeth can be formed and then mechanically processed to permanently engage with itself in a manner resembling the engagement of an array of snap fittings.

It may be particularly appreciated by consideration of FIGS. 4 through 7 inclusive that the illustrated component, while providing a complex surface, includes no undercuts. This property is generally a goal in plastic molding, as the absence of interference greatly simplifies both mold-making and part extraction.

Arrays of the type shown may be made by injection molding, but may also be made by extrusion, embossing, compression molding, or other rotary forming process. Parts may also be cast, machined, or 3D-printed, and it is not intended for the disclosure to be limited to a particular process or mode of fabrication.

It is also understood that the absence of undercuts is a convenience and not a requirement, and it is fully recognized that undercuts can be allowed in small, flexible features, to the extent that the molded elements can be extracted from their mold cavities through momentary flexure or deformation of the undercut features.

Certain classes of plastics used in the making of wear-resistant ski bases, for example, ultra-high molecular weight polyethylene (UHMWPE), are preferably processed by compression molding. In such a case, a dimensioned blank is preformed and inserted between two molds, and the design imparted to the polymer blank through the application of heat and mechanical pressure.

Polymers which may be used in ski bases include polyethylene, polyesters, polychlorotrifluoroethylene, polyether ether ketone, Nylon 6/6-PA (Polyamide), or fluorinated ethylene propylene (FEP). Polymer formulations specific to low temperatures and winter sports applications are known, such as Vestamid 1401 (Evonik, Essen, Del.). Such materials may be amenably used or adapted in view of the teachings of the present disclosure.

In general, polymers for ski base components are selected for a combination of resiliency, water repellency, wear resistance, fatigue resistance, and low friction. The disclosure may also employ polymer alloys, insert molding, slip molding, over-molding, coatings, laminations, co-extrusion, or other operations that combine performance attributes of plural materials.

In the disclosure, the choice of polymer may consider the flexural modulus and persistence and consistency of spring tension during the projected functional lifetime the component. The consistency of behavior over a range of ambient temperatures is of course essential to the reliable use of equipment in winter, polar, or high-altitude environments. The performance characteristics of the active components may therefore be chosen to be consistent across a temperature range, but may also be conscientiously chosen to vary according to anticipated thermal range at the snow surface.

Figure 4:
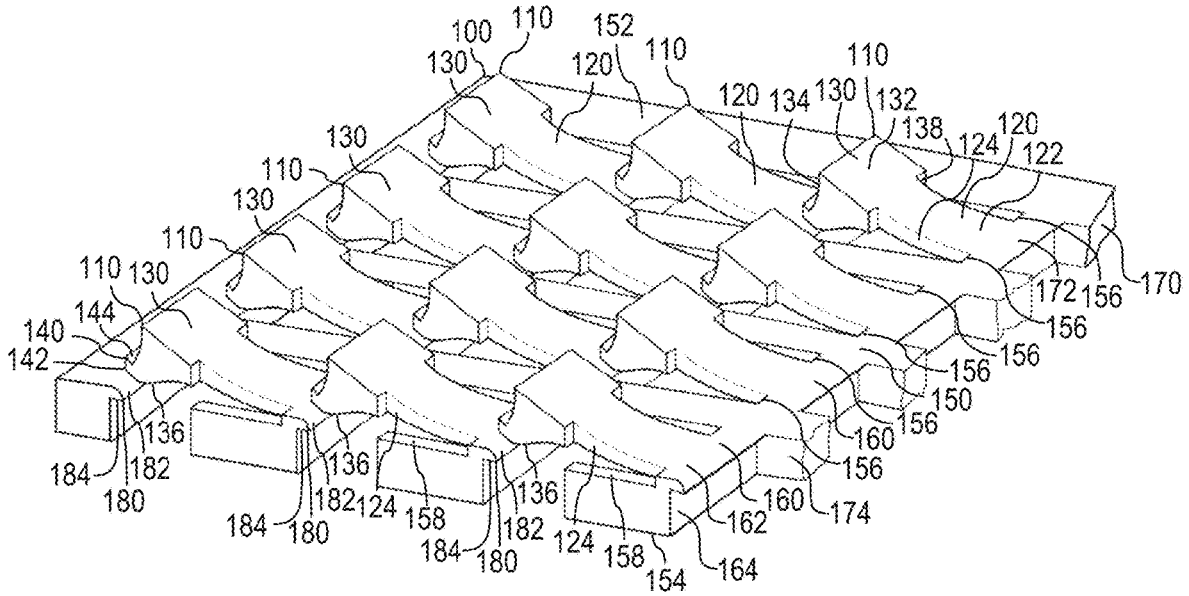
FIG. 4 is a partially cut away perspective view of an agile traction component prior to mechanical engagement of teeth, schematically showing the tooth array as it appears immediately subsequent to molding.

Returning to the relevant drawings, the detailed structure and mechanical modification of teeth 110 within thrust-adaptive relief module 100 may be understood by further reference to FIGS. 4 through 7 inclusive. FIG. 4 is a partially cut away perspective view of agile traction component prior to mechanical engagement of teeth, schematically showing the tooth array as it appears immediately subsequent to molding. FIG. 5 is a schematic elevation view of agile traction component being mechanically processed through a pair of rollers to permanently engage its teeth with its surrounding matrix.

FIG. 6 is a is a partially cut away perspective view of the traction component of FIG. 4, subsequent to the mechanical engagement of the teeth, and shows the teeth in their default extended position. FIG. 7 is a is a partially cut away perspective view of the traction component of FIG. 4, subsequent to the mechanical engagement of the teeth, showing the teeth in their flush, retracted position, as when the force of snow-covered terrain is being applied to the component.

Thrust-adaptive relief module 100 includes a plurality of teeth 110 disposed with a monolithic molded part. Tooth beam 120 includes tooth beam external surface 122, and tooth beam side 124. Tooth beam 120 is geometrically contiguous with tooth head 130. Tooth head 130 includes tooth head external surface 132, tooth head face 134, tooth internal face 136, and tooth back face 138.

Thrust-adaptive relief module 100 includes features which are devised to mechanically trap the flexed teeth, and keep them at a specific relief height under a known degree of spring tension. This mechanical engagement is provided for by two interlocking features that mutually engage under the application of mechanical pressure. Tooth retention hook 140 is disposed along the internal side of tooth internal face 136. Tooth retention hook 140 includes tooth entry face 142, and tooth retention face 144.

Tooth array matrix 150 provides a supporting grid for teeth 110 and a rigid framework for the retention of the mechanically modified, spring-loaded teeth.

Tooth array matrix 150 includes array matrix external surface 152, array matrix internal surface 154, array matrix relief channel 156, and offset channel bottom 158.

Array matrix transverse bar 160 includes transverse bar external wall 162 and transverse bar sidewall 164. Array matrix longitudinal bar 170 includes longitudinal bar external wall 172 and longitudinal bar sidewall 174.

It may be seen that array matrix transverse bar 160 and array matrix longitudinal bar 170, while features of a monolithic components, may be understood conceptually to define a grid or lattice within whose interstices are located an array thrust-responsive teeth 110. The matrix includes matrix retention hook 180, which itself includes matrix hook entry face 182 and matrix hook retention face 184.

The modification process that induces the teeth to permanently engage with the surrounding matrix under spring tension may be understood by simultaneous reference to FIGS. 5, 6, and 7. The modification is imparted by encouraging tooth retention hook 140 and matrix retention hook 180 to momentarily deform and bypass on another so that each tooth in the monolithic array is pressed into a substantially permanent interlocked state with the surrounding matrix.

Mechanical processing line 50 includes two rollers, upper roller 52 and lower roller 54. The rollers mat be made of any rigid material, but, to avoid marring of the articulating array material or parts, may amenably include a metal core and a hard elastomeric contact cylinder. The rollers may be geared or electronically timed to move together in the counter-rotating fashion indicated by the curved arrows. Alternately, the processing line may use a powered drive roller and an unpowered idler roller. The relative motion of the rollers is shown by clockwise arrow 5 and counterclockwise arrow 6.

Depending on the array design, platen or relief-patterned carrier panel may be used to impart force in an equalized or localized manner. Upon activation of the rollers, the array is impelled through the gap between the rollers in the direction indicated by directional arrow 4. The quality and consistency of the modified relief may be monitored by machine vision, or by diverse other measuring or qualification devices know to those practiced in the art of manufacturing.

As thrust-adaptive relief module 100 passes into the nip of the opposed rollers, thrust-responsive teeth 110 are momentarily deformed and pressed permanently into new positions. The teeth are entrapped in the array matrix, yet remain subject to elevating spring force and are free to retract into a flush position. Mechanically modified thrust-adaptive array 101 shows mechanically modified thrust-responsive teeth 111 in their modified locations.

More specifically, under the expression of mechanical force, the leading edges of tooth entry faces 142 and matrix hook entry faces 182 meet and ramp past one another. The momentary deformation may include not only the flexural deformation of the hooked elements, but may encompass the intentionally induced arching of tooth beam 120.

Once the apices of the ramped features bypass one another, the head of each tooth is irreversibly captured, under spring tension, by the matrix. The outward motion of the tooth is permanently limited by contact between tooth retention face 144 and matrix hook retention face 184.

Upon completion of this mechanical conversion, the array of teeth will resemble the teeth in the partially cut away view shown in FIG. 6. It may be seen by reference to FIGS. 6 and 7 that the travel of the teeth is now structurally limited at both at their outward and inward extensions. The teeth within mechanically modified thrust-adaptive array 101 will therefore intrinsically toggle between the two illustrated states of activity, as the skier's bodily movements and weight distribution interact with the array's structure.

Many variations and adaptations of the disclosure are envisioned. For example, the relief channel may be inset into the side of the tooth, making the beam have a narrower width than the head. The relief channel may alternately be inset into the longitudinal bars of the matrix, making the beam and tooth of continuous width.

FIGS. 4 through 7 inclusive show the former variant, while FIGS. 8 through 11 inclusive show the latter case. In FIGS. 8 through 11, the relief channels are shared by each pair of neighboring teeth, which allows for a simplified layout. Irrespective of the design, the longitudinal sides of the teeth and the beam need not be rectilinear, and may be tapered, curved, stepped, or convoluted in pattern.

Figure 8:
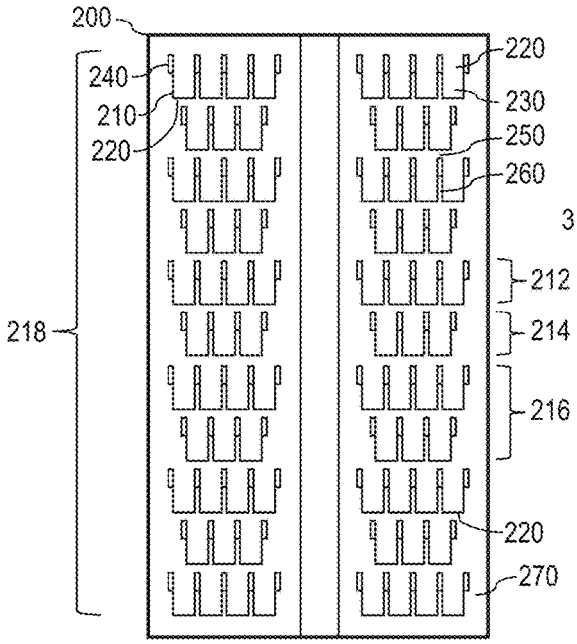
FIG. 8 illustrates a thrust-responsive traction component formed according to the disclosure, having transverse rows alternately offset from one another.

FIGS. 8 through 11 inclusive illustrate a range of layouts that depart from a strict rectilinear grid. FIG. 8 illustrates a thrust-responsive traction component having transverse rows alternately offset from one another. Offset exemplary tooth array 200 includes offset array tooth 210. Rows of teeth are characterized by offset array even rows 212 alternating with offset array odd rows 214. Each set of odd and even rows defines offset array module 216, which may be repeated to generate offset array tooth pattern 218.

Features analogous to former embodiments of the fundamental design include offset tooth beam 220, square tooth head 230, square tooth active edge 232, offset tooth beam release channel 240, offset array matrix 250, offset array transverse bar 260, and offset array longitudinal bar 270.

Figure 9:
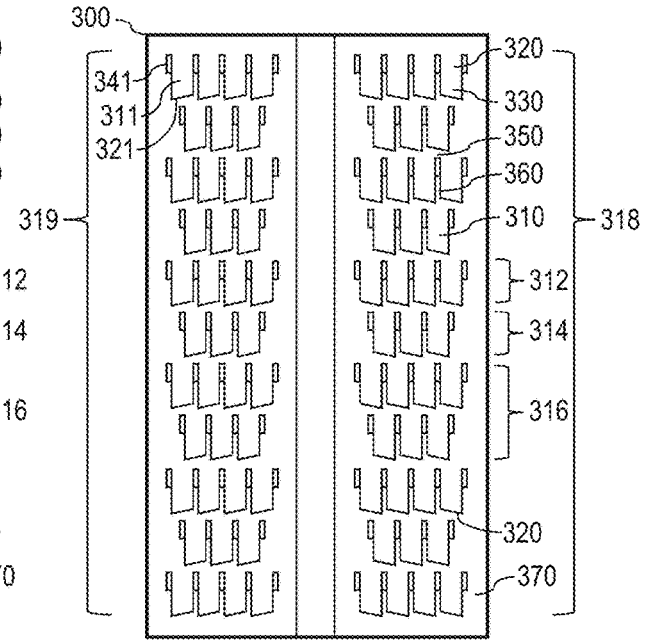
FIG. 9 illustrates a traction component having transverse rows alternately offset from one another, in which the faces of the teeth are obliquely sheared and symmetrical about the longitudinal centerline of the ski.

FIG. 9 illustrates a traction component having transverse rows alternately offset from one another, in which the faces of the teeth are obliquely sheared and symmetrical about the longitudinal centerline of the ski. This configuration can provide a moderate wedging force in which the bilateral symmetry of the two sides of the ski base induces a degree opposing, angular action that assists in keeping the ski on a consistent linear path.

Referring now to the detailed features shown in FIG. 9. Offset bilateral oblique array 300 includes a plurality of offset bilateral oblique teeth 310 disposed upon a chevron-like convergent abstract lattice. Right-side offset bilateral oblique array even rows 312 alternate with right-side offset bilateral oblique array odd rows 314 to form right-side offset bilateral oblique array tooth module 316.

A succession of right-side offset bilateral oblique array tooth modules 316 is repeated over the requisite design length to form right-side offset bilateral oblique array tooth pattern 320. This periodic structure is mirrored in left-side offset bilateral oblique array tooth pattern 330, with analogous structural features repeated throughout.

Features substantially in common with previous embodiments oblique tooth active head 340, oblique tooth active edge 342, oblique tooth beam release channel 350. While the geometrical layout is not a rectilinear grid in this case, it may be appreciated that offset bilateral matrix 350, including offset bilateral transverse bars 360, and offset bilateral longitudinal bar 370, nevertheless provide designated regions of periodic structural features.

Figure 10:
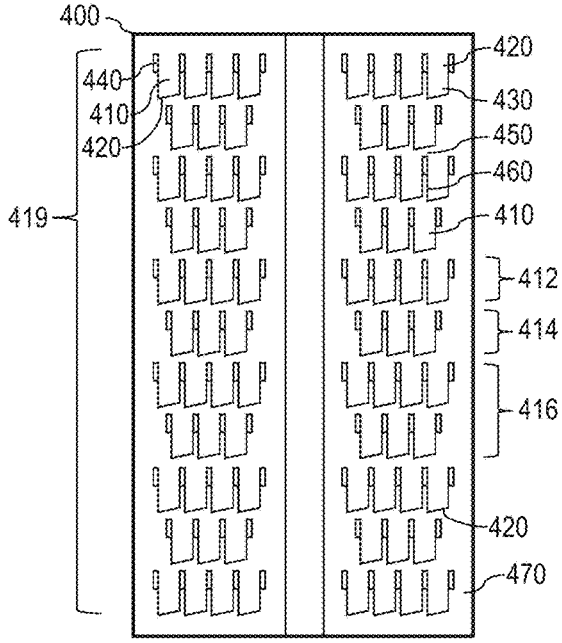
FIG. 10 illustrates a traction component having rows transverse rows alternately offset from one another, in which the tooth faces are obliquely sheared, and in which each tooth is geometrically similar to the others, in which the pattern for the first ski is designated to mirror its counterpart in a pair of skis.
Figure 11:
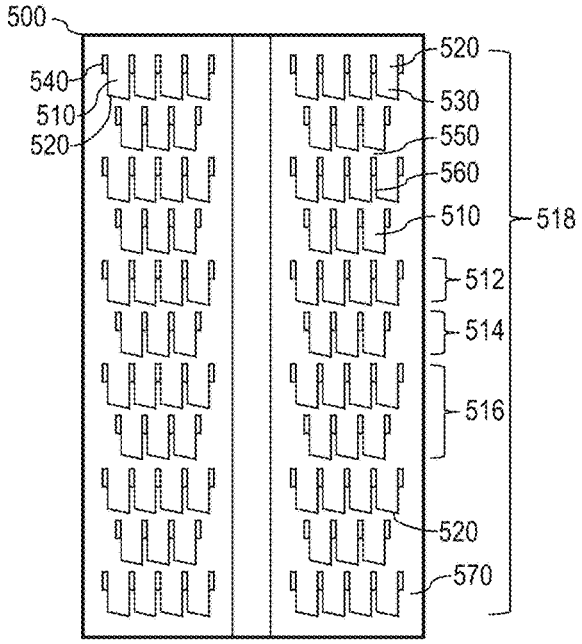
FIG. 11 illustrates a traction component having rows transverse rows alternately offset from one another, in which the tooth faces are obliquely sheared, and in which each tooth is geometrically similar to the others, in which the pattern for the first ski is designated to mirror its counterpart in a pair of skis, as represented through contrasting reference to FIG. 10.

FIGS. 10 and 11 illustrate right and left skis with dissimilar but geometrically symmetrical traction arrays. FIG. 10 illustrates a traction component for a right ski having rows transverse rows alternately offset from one another, in which the tooth faces are obliquely sheared to the left when viewed from the bottom.

FIG. 11 illustrates a traction component for a left ski having rows transverse rows alternately offset from one another, in which the tooth faces are obliquely sheared to the right when viewed from the bottom. Within each of the two patterns, each tooth is geometrically similar to the others, and the pattern for the first ski is designed to mirror its counterpart within a pair of skis.

This pair of skis may be viewed in contrast with FIG. 9, in which each tooth on each side of each individual ski is geometrically similar to the others, but in which the pattern for the right half ski is designated to mirror its left-side counterpart. The distinct right and left patterns shown in FIG. 10 and FIG. 11 may be understood to provide an advantage to skiers who require a centration of motile force from off-axis natural muscular bias. Distinct right and left articulating tread patterns of this class may also be elected by skiers who prefer a skating motion, in which a non-linear angular thrusting action is employed as a conscientious technique.

Referring now to the details of the right-ski array shown in FIG. 10, right-ski offset oblique array 400 includes a plurality of right-ski oblique teeth 410. Right-ski offset oblique array even rows 412 alternated along the length of the component with right-ski offset oblique array odd rows 414, each set of offset odd and even rows defining right-ski offset oblique array module 416. A plurality of whole and partial periodic modules comprises right-ski offset oblique array tooth pattern 418.

Elements comparable to preceding descriptions of the disclosure include right-ski oblique tooth beam 420, right-ski oblique tooth active head 430, right-ski oblique tooth active edge 432, right-ski oblique tooth beam release channel 440, right-ski oblique matrix 450, right-ski transverse bar 460, right-ski longitudinal bar 470.

Referring now to the details the left-ski array shown in FIG. 11, left-ski offset oblique array 500 includes a plurality of left-ski oblique teeth 510. Left ski-offset oblique array even rows 512 alternated along the length of the component with left-ski offset oblique array odd rows 514, each set of offset odd and even rows defining left-ski offset oblique array module 516. A plurality of whole and partial periodic modules comprises left-ski offset oblique array tooth pattern 518.

Elements again comparable to preceding descriptions of the disclosure include left-ski oblique tooth beam 520, right ski oblique tooth active head 530, right ski oblique tooth active edge 532, right ski oblique tooth beam release channel 540, right ski oblique matrix 550, right ski transverse bar 560, right ski longitudinal bar 570.

It may be granted that, although the transverse bars in right-ski offset oblique array 400 and left-ski offset oblique array 500 are devised at an oblique design angle, and the teeth are alternately offset, the illustrated arrays nevertheless constitute periodic patterns arranged upon geometrical lattices, and this understanding is embraced with this specification of the disclosure.

While such periodicities and regularities are efficiently implemented within the disclosure, the scope of the disclosure is not meant to exclude other practices and implementations. For example, the teeth may be convexly or concavely profiled, may be have a chevron shape with either an acute or obtuse point. Teeth may electively be provided different sizes, widths, lengths, layouts, orientations, beam thicknesses, spring tensions, or materials in different locations with an array, or within a set of arrays upon a ski or a pair of skis.

Arrays formed according the disclosure may thereby be tailored for diverse users and uses. While not every modification can be catalogued in this specification, exemplary modifications can characterize the utility of certain envisioned variants of the disclosure.

Figure 12:
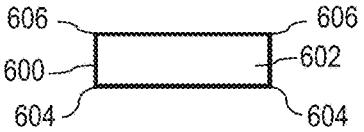
FIG. 12 is an exemplary sectional view of a rectangular tooth beam, showing the simple sectional form of the beam element that imparts persistent spring force between the persistently engaged snap fittings.

In the following figures, the beam that supports the tooth under spring force in a monolithic array is variously modified to tune the resistant spring force, applied in the default state to the teeth, to a predetermined value. FIG. 12 is an exemplary sectional view of a geometrically simple rectangular tooth beam, showing the sectional form of a simple beam element that imparts persistent spring force between the effectively permanently engaged snap fittings.

Figure 13:
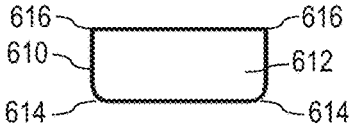
FIG. 13 is an exemplary sectional view of a solid rectangular tooth beam having radiused bottom edges.

FIGS. 13 through 18 inclusive illustrate how a tooth beam can be modified to provide a range of resistance to externally applied deflection forces within an interchangeable set of modular inserts having a similar outward aspect. FIG. 13 is an exemplary sectional view of a deep rectangular tooth beam having radiused bottom edges.

Other parameters being constant, and relative to the simple beam shown in FIG. 12, deep rectangular beam profile 610, which is defined, in solid form, by deep rectangular beam body 612 having internal edge radius 614, the deepened rectangular beam profile will provide greater resistance to deflection.

FIGS. 14 through 17 inclusive illustrate how deep rectangular beam profile 610 can be progressively modified with channels of increasing depth to allow for varied deflection resistance. This practice provides a quantified and calibrated set of modular parts that can be interchanged to suit the personal properties and practices of the individual skier.

Figure 14:
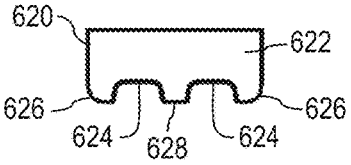
FIG. 14 is an exemplary sectional view of a rectangular tooth beam having internal channels one-fifth the overall thickness of the tooth beam.

FIG. 14 is an exemplary sectional view of a rectangular tooth beam having internal channels four-fifths the overall thickness of the tooth beam. Four-fifths thickness channeled beam section 620 includes four-fifths thickness channeled beam body 622. Four-fifths thickness channeled beam sidewall 624 runs along a predetermined length of the tooth beam corresponding to the formation of four-fifths thickness channeled beam channel 626. Four-fifths thickness channeled beam spine 628 runs along the centerline of the tooth beam.

Figure 15:
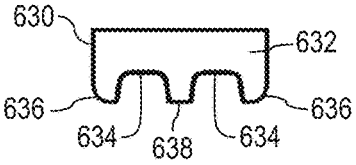
FIG. 15 is an exemplary sectional view of a rectangular tooth beam having internal channels two-fifths the overall thickness of the tooth beam.

FIG. 15 is an exemplary sectional view of a rectangular tooth beam having internal channels three-fifths the overall thickness of the tooth beam. Three-fifths thickness channeled beam section 630 includes three-fifths thickness channeled beam body 632. Three-fifths thickness channeled beam sidewall 634 runs along a predetermined length of the tooth beam corresponding to the formation of three-fifths thickness channeled beam channel 636. Three-fifths thickness channeled beam spine 628 runs along the centerline of the tooth beam.

Figure 16:
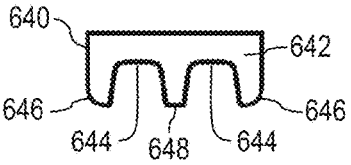
FIG. 16 is an exemplary sectional view of a rectangular tooth beam having internal channels three-fifths the overall thickness of the tooth beam.

FIG. 16 is an exemplary sectional view of a rectangular tooth beam having internal channels two-fifths the overall thickness of the tooth beam. Two-fifths thickness channeled beam section 640 includes two-fifths thickness channeled beam body 642. Two-fifths thickness channeled beam sidewall 644 runs along a predetermined length of the tooth beam corresponding to the formation of three-fifth thickness channeled beam channel 646. Two-fifths thickness channeled beam spine 648 runs along the centerline of the tooth beam.

Figure 17:
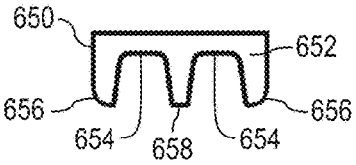
FIG. 17 is an exemplary sectional view of a rectangular tooth beam having internal channels four-fifths the overall thickness of the tooth beam.

FIG. 17 is an exemplary sectional view of a rectangular tooth beam having internal channels one-fifth the overall thickness of the tooth beam, one-fifth thickness channeled beam section 640 includes one-fifth thickness channeled beam body 642. One-fifth thickness channeled beam sidewall 644 runs along a predetermined length of the tooth beam corresponding to the formation of one-fifth thickness channeled beam channel 646. One-fifth thickness channeled beam spine 648 runs along the centerline of the tooth beam.

In FIGS. 14 through 17, the channeled beam provides stiffening ribs on the outside of the beam and along the centerline of the beam. These ridges provide a progressive lessening of the default deflection resistance, while still providing an external barrier against the incursion of ice or water into the hollow interior voids within the array.

The alternation of channels and ridges also deters twisting of the beam, which might otherwise cause the deflecting tooth to jam. This modification therefore allows tight tolerances to be observed in the setting of the teeth within their respective recesses, which again allows reliable operation while in contact with crystalline snow or any associated surface moisture.

Channels of varying depth may be introduced into a monolithic molded part by providing the mold with a set of removable mold components bearing ridges of varying depths. These may be installed with a dedicated recess or upon mold pins. The use of an interchangeable plate of this type can reduce to cost of mold production, and allow inventories of parts to be quickly and responsively filled to a timely volume.

Functionally, the tailoring of the deflection resistance allows the articulation of the teeth to occur in response to differing applied forces. These factors include, but are not limited to, user weight and prevailing snow conditions. A relatively light skier may be matched with an articulating array having lower deflection resistance, while a relatively heavier skier will optimally be matched with an articulating array having a relatively greater deflection resistance.

Deep, loose, powder remains brittle even under significant compression. Accordingly, a skier of a given weight will optimally require deeper mechanical engagement with powder than when skiing over shallow, compacted cover. During active forward motion, a skier navigating deep powder would normally prefer that the teeth remain retracted whenever in substantial contact with the terrain. Because, in deep powder, there is less intrinsic resistance in the snow layer, a user would therefore generally elect an articulating array having a relatively low deflection resistance.

Aggressive skiing and extended use can impart wear and deformation of molded components. The disclosure includes designs which by anticipating such wear and deformation can improve performance prolong the operational lifetime of the articulating array.

Figure 18:
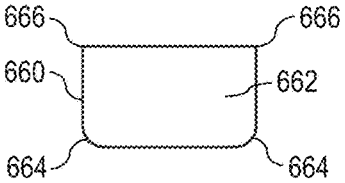
FIG. 18 shows an exemplary radiused, rectangular tooth section having square external corners.

FIG. 18 shows an exemplary radiused, rectangular tooth section having square external corners. Travel over unyielding mineral surfaces such as rocky terrain, roads, or parking lots, while they would generally induce the teeth retract, can nevertheless result in damage to the extended or retracted teeth.

Referring to FIG. 18, rectangular tooth section 660 includes rectangular tooth body 662, which exhibits rectangular tooth radius 664 and relatively sharp rectangular tooth corner 666. Unwelcome and unanticipated swaging of the teeth, particularly around the sharp, external corners, might cause the teeth to jam within their associated recesses.

Figure 19:
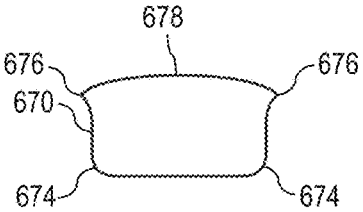
FIG. 19 is a schematic representation of the swaged wear and deformation pattern upon an originally rectangular tooth section having square external corners.

FIG. 19 is a schematic representation of a swaged wear and deformation pattern upon an originally rectangular tooth section having square external corners, such as the exemplary tooth shown previously in FIG. 18. Swaged rectangular tooth section 670 illustrates swaged rectangular tooth body 672 and includes swaged rectangular tooth radius 674. Extended contact with hard surfaces results in swaged rectangular tooth cusp 676 and swaged rectangular tooth convex external face 676.

Figure 20:
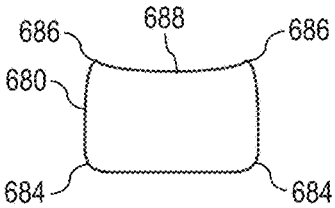
FIG. 20 is a schematic representation an alternative tooth design anticipating swaging and preventing premature jamming of the tooth edges against a surrounding matrix.

It may be appreciated that the spreading of the external region of the tooth profile broadens the dimension, and can ultimately deter the full retraction of the head into its dedicated recess. FIG. 20 is a schematic representation a conscientiously modified tooth design anticipating swaging, and preventing incomplete retraction and premature jamming of the tooth edges against the matrix. Anti-swaged rectangular tooth section 680 includes anti-swaged rectangular tooth body 682 and anti-swaged rectangular tooth radius 684. Anti-swaged rectangular tooth reverse cusp 686 and anti-swaged rectangular tooth convex external face 686 are intentionally introduced into the mold design and finished part.

It may be seen by this modification that the cuspated spur and spreading produced by the swaging of the tooth is essentially anticipated and inverted in the shaping of the original molded part. The modified tooth therefore may be subjected to a period of progressive swaging during extended use, while remaining fully active and effective. Alternately, this forethought may inform the election of a draft angle in the tooth and recess, so that, similarly, the bypass of a tooth in its given recess within its surrounding matrix is ensured.

Figure 21:
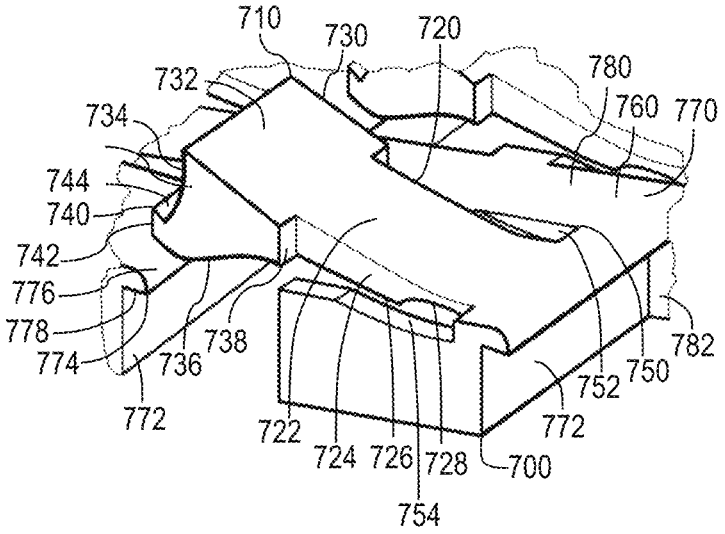
FIG. 21 shows a perspective view of a modified tooth design having a transverse channel that creates a live hinge at a thinned location upon the tooth beam.

FIGS. 21 through 24 show a range of modifications that accommodate variations in material, deflection parameters, or other engineering considerations. FIG. 21 shows a perspective view of a modified tooth design having a transverse channel that creates a live hinge at a thinned location upon the tooth beam. Live-hinged tooth array 700 includes a plurality of live-hinged teeth 710. Each tooth includes live-hinged tooth beam 720 having a geometrically continuous external surface 722. In contrast, internal beam surface 726 is discontinuous, having live-hinged beam tooth transverse channel 728 formed in the internal beam surface 726.

Live-hinged beam tooth transverse channel 728 abruptly distinguishes solid tooth beam region 724 the live-hinged zone. Elements substantially corresponding to previous descriptions in this specification include live-hinged tooth head 730, live-hinged tooth external face 732, live-hinged tooth return face 734, live-hinged tooth retention hook 740, live-hinged tooth retention face 742, live-hinged tooth entry face 744, live-hinged tooth array matrix 750, live-hinged array matrix external surface 752, live-hinged array matrix internal surface 754, live-hinged array matrix relief channel 756, live-hinged offset channel bottom 758, live-hinged array matrix transverse bar 760, live-hinged transverse bar sidewall 762, live-hinged array matrix longitudinal bar 770, live-hinged longitudinal bar sidewall 772, live-hinged matrix retention hook 780, live-hinged matrix hook lead face 782, and live-hinged matrix hook retention face 784.

The live-hinge design can be used in articulating arrays in which a relatively light deflection resistance is desired, or in which a relatively stiff and brittle beam material might fracture if otherwise devised. It can also be employed when the elected material is known to have a threshold of fatigue resistance which may be overcome by the limitation of the transverse sectional dimension to a predetermined, reduced thickness.

Figure 22:
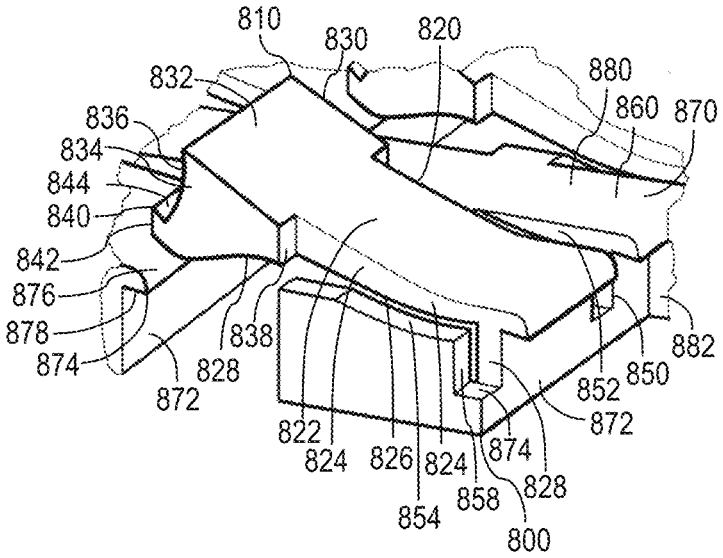
FIG. 22 shows a perspective view of a modified tooth design having its sides further relieved, so that an upright region of the matrix is freed to deflect in a longitudinal direction and promote the momentary dislocation of the beam during mechanical modification of the tooth array after molding.

FIG. 22 shows a perspective view of a modified tooth design having its sides further relieved, so that an upright region of the transverse matrix bar is freed to deflect in a longitudinal direction and promote the momentary dislocation of the beam during mechanical modification of the tooth array after molding.

Side-relieved tooth array 800 includes a plurality of side-relieved teeth 810 each possessing a corresponding side-relieved tooth beam 820. Side-relieved beam tooth external face 822, side-relieved tooth side faces 824, and side-relieved tooth internal face 826 geometrically define surfaces of a typical tooth. Side-relieved tooth head 830 includes side-relieved tooth head external face 832, which is geometrically continuous with side-relieved beam tooth external face 822.

Side-relieved tooth head traction face 834, side-relieved tooth head internal face 836, side-relieved tooth head return face 838, side-relieved tooth retention hook 840, side-relieved tooth retention face 842, and side-relieved tooth entry face 844 side-relieved tooth array matrix 850 define distinct geometrical faces in the region including the head of the tooth.

Side-relieved array matrix external surface 852 and side-relieved array matrix internal surface 854 define major surfaces of the illustrated array. Side-relieved array matrix relief channel 856 and side-relieved offset channel bottom 858 compose the design modification that provides increased longitudinal deflection.

Structural details that parallel previous embodiments include side-relieved array matrix transverse bar 860, side-relieved transverse bar sidewall 862, side-relieved array matrix longitudinal bar 870, side-relieved longitudinal bar sidewall 872, side-relieved matrix retention hook 880, side-relieved matrix hook lead face 882, side-relieved matrix hook retention face 884.

Figure 23:
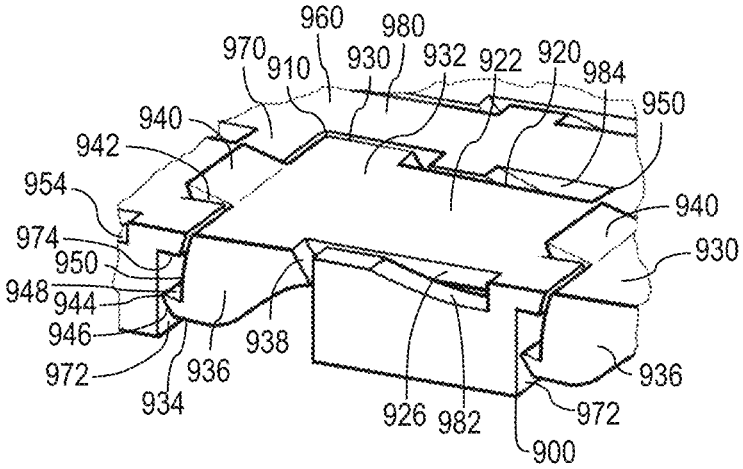
FIG. 23 shows a perspective view of a modified tooth design having a short ramp appended its front edge to actively trigger the lifting of the tooth under the application of thrust.

Under certain operational conditions, it may be desirable to trigger the raising of the teeth by including a small raised feature present even during the full permitted retraction of the teeth. FIG. 23 shows a perspective view of a modified tooth design having a short ramp appended its front edge to actively trigger the lifting of the tooth under the application of thrust.

Ramp tooth array 900 includes a plurality of ramp teeth 910, each including ramp tooth beam 920 and ramp tooth head 930. Ramp tooth beam 920 includes ramp beam external face 922 and ramp beam side face 924. Ramp tooth head 930 includes ramp tooth external face 932, ramp tooth internal face 934, ramp tooth end face 936. Ramp tooth external face 932 surrounds ramp tooth lead ramp 940, which is further defined by ramp side faces 942. Ramp tooth front face 950 raises and lowers in an arcuate motion. The profile of ramp tooth front face 950 is geometrically defined by that path of motion.

Ramp tooth array matrix 960 surrounds and supports the array of ramped teeth, and includes ramp tooth transverse matrix 970 and ramp tooth longitudinal matrix 980. Ramp tooth array matrix sidewalls 972 define the cells into which the teeth retract.

A further modification is shown by ramp array sloped matrix relief channel bottom 982 and ramp array sloped matrix relief channel sides 984. The convex hollow minimizes the volume of the void necessary to release the beams, so that they may be readily flexed into position, while leaving a minimized void volume.

Ramp tooth lead ramp 940 remains proud of the surface while the tooth is fully retracted. Ramp tooth retention hook 944 includes ramp tooth hook entry face 946 and ramp tooth hook retention face 948. When the teeth are raised, ramp tooth hook retention face 948 bears upon matrix retention face 974, which thereby limits the outward stroke of the tooth.

Figure 24:
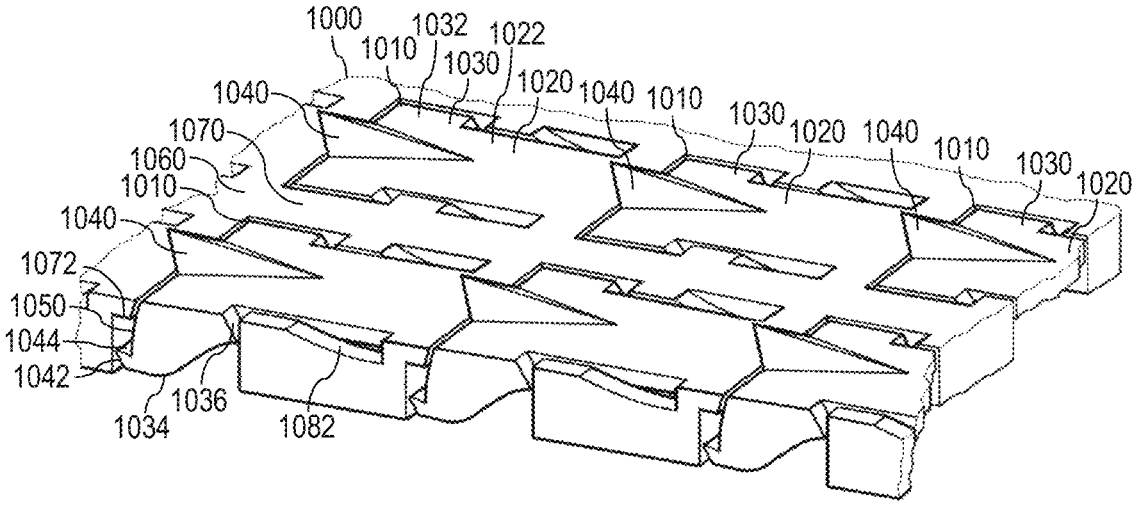
FIG. 24 shows a perspective view of a modified tooth design having a raised cleft formed upon the tooth head to actively trigger the lifting of the tooth under the application of thrust, and to also provide a degree of linear tracking.

FIG. 24 shows a perspective view of a modified tooth design having a raised dart formed upon the tooth head to actively trigger the lifting of the tooth under the application of thrust. In contrast to the embodiment illustrated in FIG. 23, this design provides a degree of linear tracking as well as lifting force.

Tracking tooth array 1000 includes a plurality of tracking teeth 1010. Each toothed feature within a matrix includes tracking tooth beam 1020 and tracking tooth head 1030. Pointed tracking tooth guide dart 1040 extends from the head of the tooth, and remains raised while the tooth is retracted. Tracking tooth beam face 1022, tracking tooth external face 1032, tracking tooth front face 1050, tracking tooth internal face 1034, and tracking tooth back face 1036 further define the surfaces of the body of the toothed element.

Tracking tooth entry face 1042 encourages passage of the flexed teeth during mechanical modification. Tracking tooth retention face 1044 meets matrix retention face 1072, stopping the tooth's extension. Tracking tooth array matrix 1060 surrounds and supports the array of ramped teeth, and includes tracking tooth transverse matrix 1070 and tracking tooth longitudinal matrix 1080.

Tracking array sloped matrix relief channel 1082 minimizes the void volume and, as the ski moves across the snow, guides accumulated snow out of the relief channels. This sloped feature may be included in any of the preceding embodiments, where it can reduce clogging and fouling by encouraging snow to slide out of the void. The dart and the top of the tooth need not be abruptly differentiated, and their surfaces may be geometrically blended, or otherwise integrated, in a continuous surface.

Figure 25:
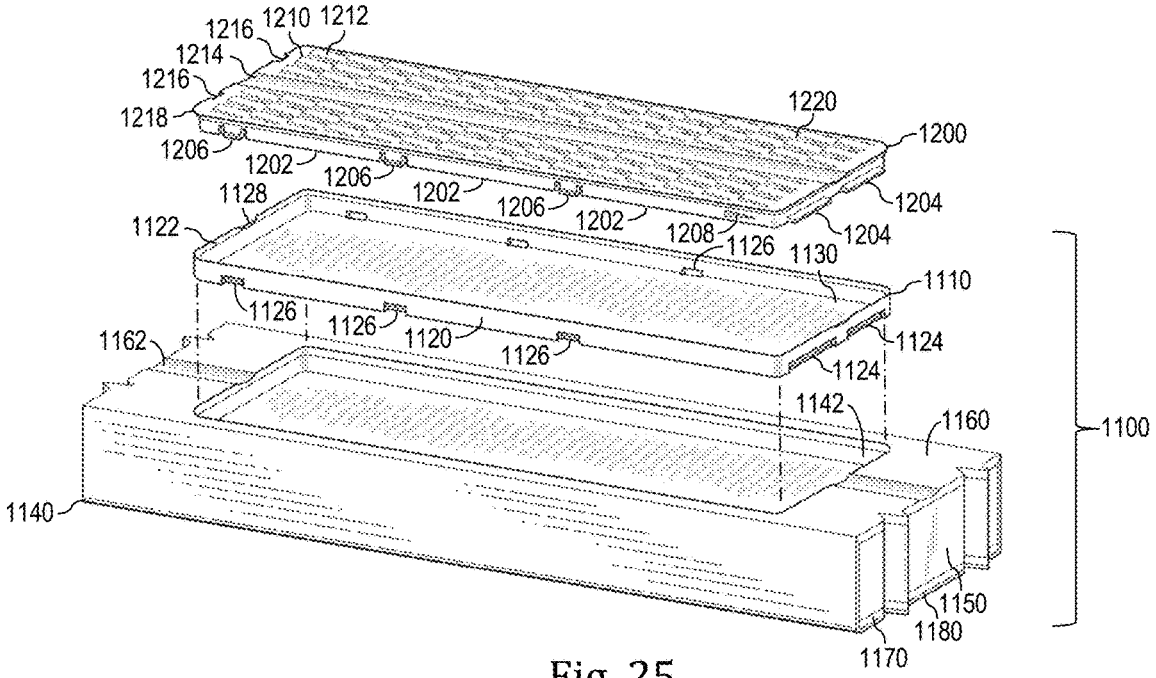
FIG. 25 illustrates an exploded view of a modular implementation of the disclosure, in which a housing is in alignment to be permanently installed within a prefabricated recess in the ski bottom, allowing various inserts formed in accordance with the disclosure to be interchanged or replaced.
Figure 26:
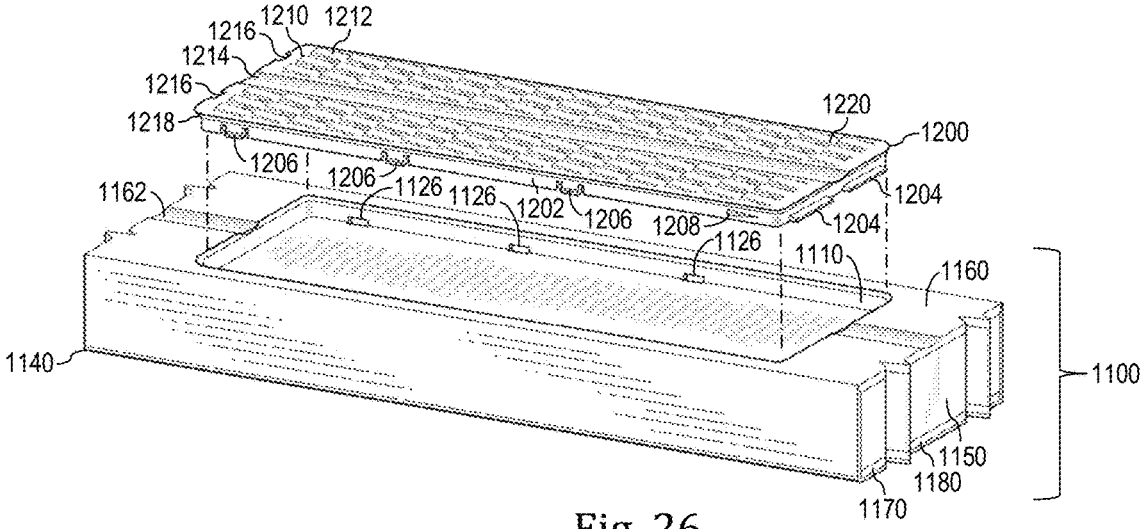
FIG. 26 illustrates a partially exploded view of a modular implementation of the disclosure in which a housing is permanently installed in the ski bottom, showing a thrust-responsive insert aligned for insertion into the housing.
Figure 27:
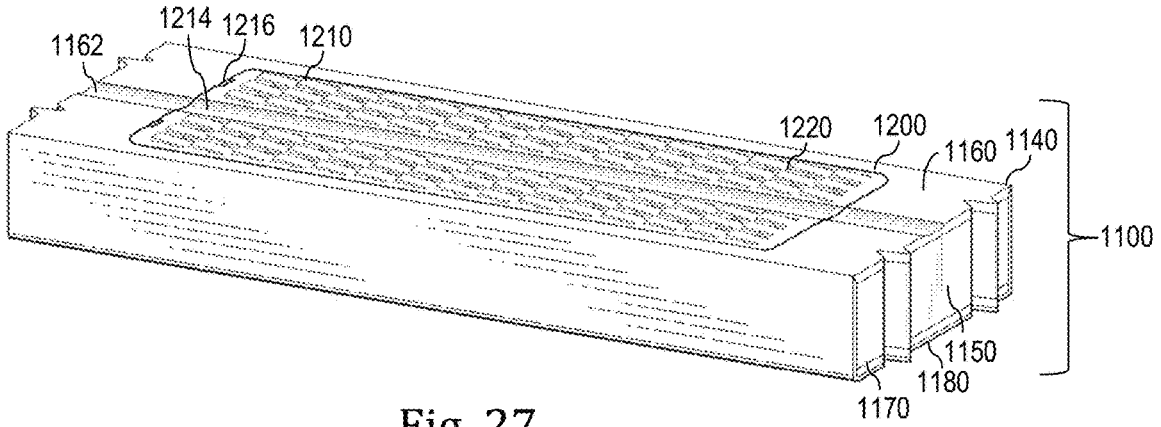
FIG. 27 illustrates a view of a modular implementation of the disclosure in which a housing is permanently installed in the ski bottom, showing a thrust-responsive insert removably installed in the housing.

FIGS. 25 through 27 inclusive illustrate the manufacture and installation of a modular system employing an articulating tooth array insert formed according to the disclosure. The system includes a receptive housing that is permanently installed into a recess in the base of the ski. An articulating tooth array insert is then installed in the receptive housing.

FIG. 25 illustrates the installation of a receptive housing into a recess formed in the bottom of a ski. FIG. 26 illustrates a partially exploded view of a modular implementation of the disclosure in which a housing is permanently installed in the ski bottom, and also shows a thrust-responsive insert aligned for insertion into the housing.

FIGS. 25 through 27 refer to a single set of components, common to each of the three named figures, and illustrate one exemplary assembly kit. This assembly kit includes receptive ski subassembly 1100 employed in conjunction with modular thrust-responsive insert 1200.

Figure 28:
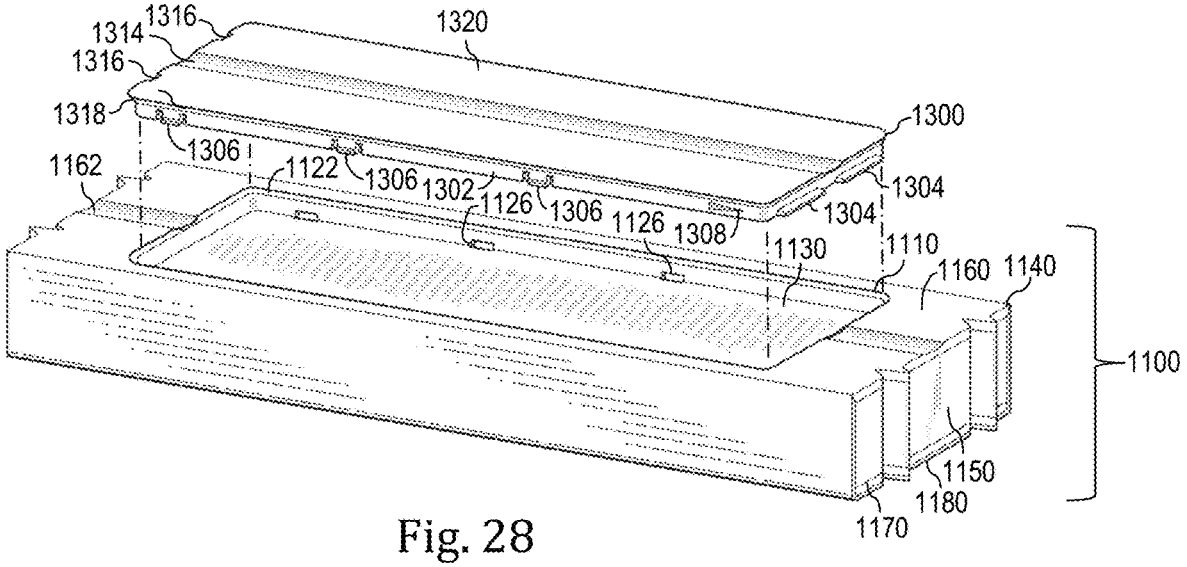
FIG. 28 shows an alternate, primarily planar insert aligned for removable insertion into the housing.
Figure 29:
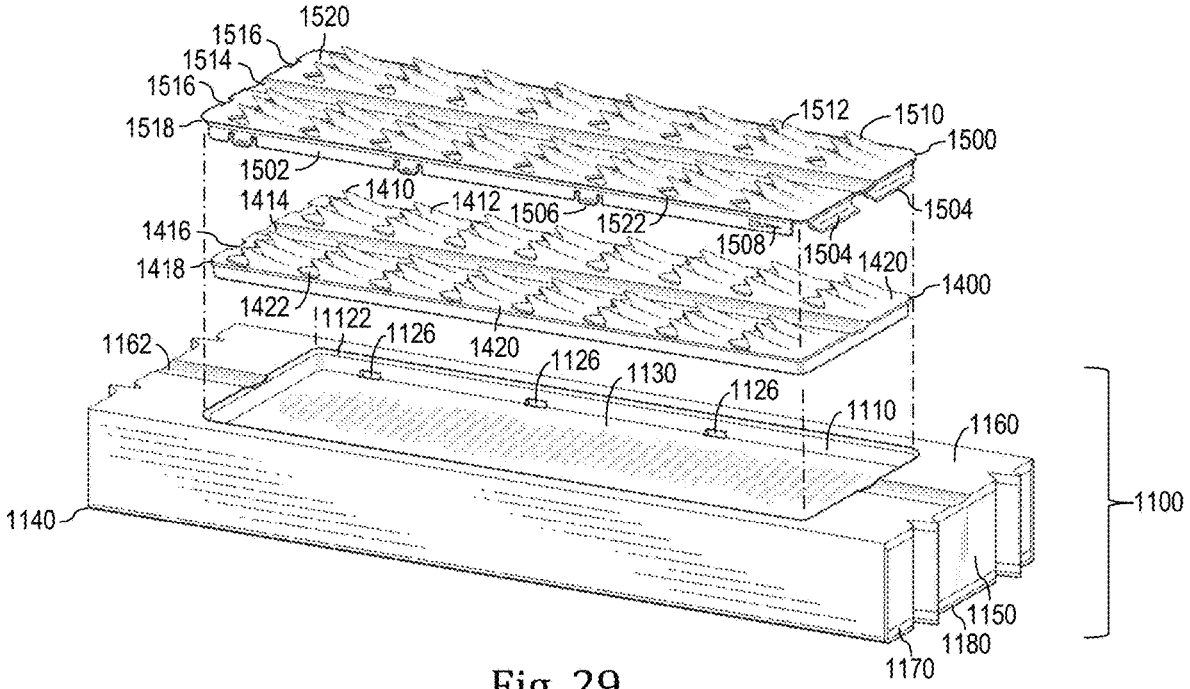
FIG. 29 is a partially exploded view illustrating the installation of a metallic, fixed tooth array with a monolithically molded fill pad.
Figure 30:
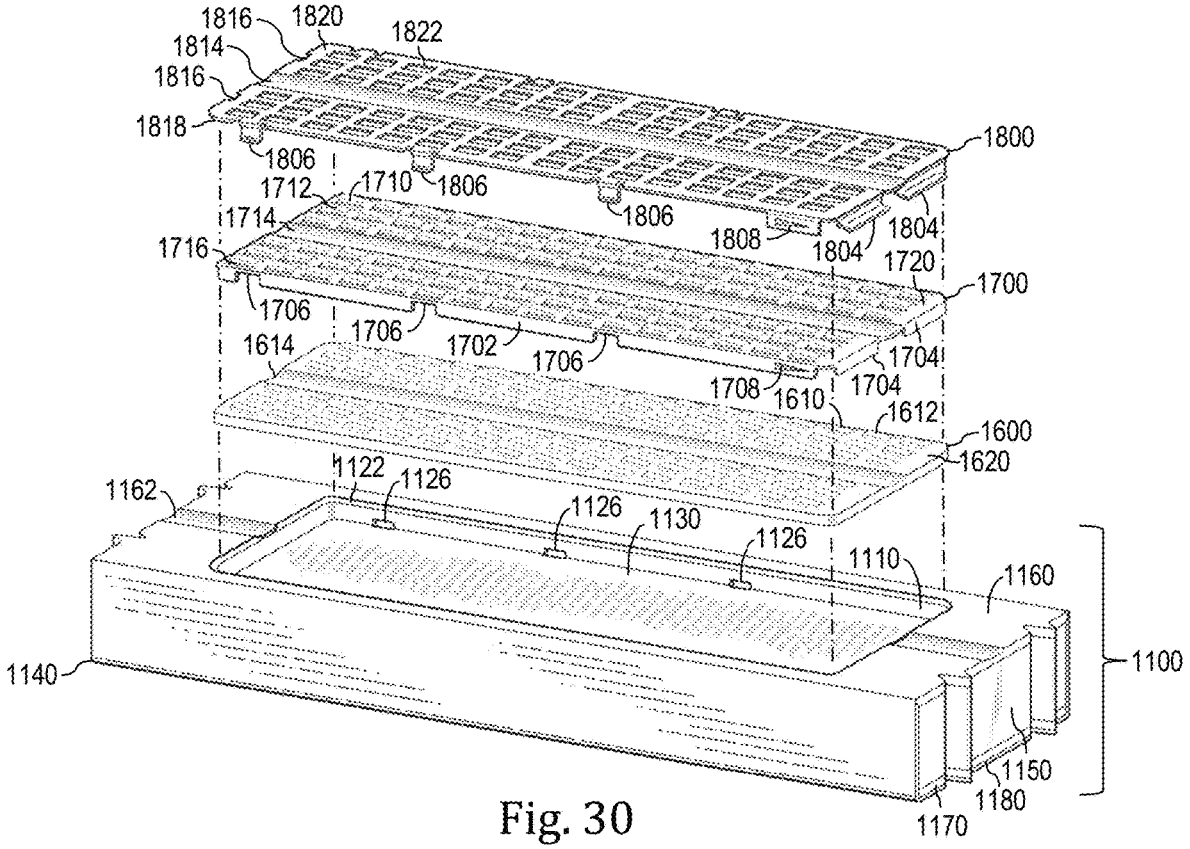
FIG. 30 is a partially exploded view illustrating a metallic insert with a self-articulating tooth array and compatibly-formed fill plate.

FIGS. 28 through 30 inclusive illustrate the design and installation a range of additional functional components which may be used in conjunction with the preinstalled housing in the base of the ski. These variants employ the same recess and receptive housing shown in FIGS. 25 through 27, but include optional inserts that illustrate additional embodiments extending the adaptability, utility, and versatility of the disclosure.

Accordingly, and throughout the relevant drawings, which include FIGS. 25-30 inclusive, receptive modular traction ski subassembly 1100 represents a shared component within a manufactured ski devised to be amenable to the installation of any structurally-compatible insert.

Returning to the first subgroup of figures, FIG. 25 illustrates an exploded view of a modular implementation of the disclosure, in which a housing is in alignment to be permanently installed within a prefabricated recess in the ski bottom. The illustration shows the receptive housing that would typically be permanently installed by the ski manufacturer.

The system is conscientiously designed to allow various inserts formed in accordance with the disclosure to be interchanged, modified, or replaced. In this first subgroup of figures, modular traction ski subassembly 1100 represents a ski outfitted with a versatile mounting system amenable for use within the disclosure. Modular articulating tooth insert 1200 features an agile tooth array formed according to the teachings of the disclosure.

Modular thrust-responsive insert 1200 encompasses an articulating tooth array formed according to the disclosure, and also integrates attachment and removal features so that differing modular components can be quickly and easily interchanged.

Accordingly, modular traction ski insert 1200 is expressly devised to reversibly engage with, and be securely retained by, the preinstalled housing. FIG. 25 illustrates modular traction ski body 1140 which has been prepared to have modular traction ski body recess 1142 formed in anticipation of the installation of a compatible and commensurate retentive housing. Modular traction ski body recess 1142 may be formed, for example, by removal of material through mechanical milling.

The ski body may be variously composed, according the broad range of practices know to the art of ski manufacture. While a ski may be as simple as a shaped piece of wood, most skis incorporate various elements which are adhered together to act as a rigid, coherent body.

In the exemplary figures, such attributes are characterized by modular traction ski core 1150, modular traction ski base 1160, modular traction ski cap 1160, and modular traction ski shell 1170. Modular traction ski base 1160 includes modular traction ski base concave groove 1162.

Traction ski core may be wrapped, fused, or laminated from a diversity of natural or synthetic materials. As noted in a previous embodiment, the ski body structure can be of diverse design, and may include strips, rods, hollow cells, edges, sheets, membranes, fabrics, fibers, foams, lattices, or honeycombs. Ski component materials may include wood, metal, glass, carbon, polymers, adhesives, or composites. The ski body electively be outfitted with metal edges or trim, depending on its intended use.

The ski body may be locally modified in the vicinity of modular traction ski base recess 1142 so that performance characteristics such as stiffness, strength, and torque resistance are occur at the desired performance levels along the full length of the ski. Modular traction ski base recess 1142 receives modular insert housing 1110, which may be adhered, mechanically fastened by screws or other hardware, or merely pressed into place within the recess. FIG. 26 shows modular insert housing 1110 fixedly installed in modular traction ski base recess 1142 within modular traction ski body 1140.

Modular insert housing 1110 is designed to receive and retain a range of compatibly-formed functional inserts. To that end, modular insert housing 1110 includes modular insert housing perimeter wall 1120 and modular insert housing bottom 1130, which delimit the receptive well into which the interchangeable components are received.

Modular insert housing perimeter bevel 1122 surrounds the outer extent of the housing, and permits an insert to be installed flush with external surface of modular traction ski base 1120. This feature discourages the incursion of water, ice and snow. The bevel may optionally include provision for receiving a surrounding ring or gasket.

Two modular insert housing leading end retention recesses 1124 are formed in the leading-end section of modular insert housing leading outer walls 1120. In the illustrated embodiment, six modular insert housing side retention recesses 1126 are provided in the longitudinal sides of modular insert housing perimeter wall 1120. Modular insert housing concave recess 1128 geometrically accords with modular traction ski base concave groove 1162.

Modular thrust-responsive insert 1200 includes modular insert perimeter wall 1202. Two modular insert leading edge retention fittings 1204 extend from the leading edge of modular insert perimeter wall 1200. Six modular insert side-edge retention fittings 1206 are provided in the form and function of a snap fitting, and are mechanically separated from perimeter wall 1202 in order to allow for flexure of the fitting. Modular insert directional indicia 1208 indicates, from either side, the preferred orientation of the insert relative to the tip of the ski.

Modular thrust-responsive insert 1200 includes a plurality of modular insert active teeth 1210 together comprising modular insert active tooth array 1212. Modular insert longitudinal tracking groove 1214 aligns geometrically with modular traction ski base concave groove 1162.

Modular insert tool access notches 1216 allow a simple, flat tool, such as a screwdriver, to be inserted along short channels formed at the bevel angle. Modular insert reverse perimeter bevel 1218 surrounds the insert. Modular thrust-responsive insert matrix 1220 provides a structural armature for modular insert active tooth array 1212.

It may be understood from consideration of the drawings that modular thrust-responsive insert 1200 may be installed most readily by tilting the insert into the recess, and introducing the two modular insert leading edge retention fittings 1204 into the two corresponding modular insert housing leading end retention recesses 1124.

The insert becomes fixed when the trailing end is made level with the ski base and all six modular insert side-edge retention fittings 1206 engage with their six corresponding modular insert housing side retention recesses 1126. In an exemplary installation using hand pressure, side-edge retention fittings 1206 are induced to snap progressively, from front to back, into side retention recesses 1126.

While the two modular insert leading edge retention fittings 1204 are identical in this depiction, they may, in other suitable embodiments, be devised to differ in dimension in order to be keyed for inserts having a preferential right or left orientation, for example, in complimentary use with the right-biased and left-biased tooth arrays shown in FIGS. 9 and 10. A housing and its designated insert may also be keyed by other structural means that interfere with improper insertion, such as ridges, slots, corner angles, or other intentional asymmetries.

FIG. 27 illustrates a modular implementation of the disclosure showing a thrust-responsive insert removably installed in the housing, showing how the meeting of modular insert housing perimeter bevel 1122 and modular insert reverse perimeter bevel 1218 provides a flush surface around the edges of the kick-zone components. This assembled modular illustrated insert kit illustrates a ski system fully ready for athletic use in accordance with the understandings of the disclosure.

Alternate or replacement components can be installed after lifting the back of the insert through use of the tool access notches 1216. It is in the scope and spirit of the disclosure that companionable inserts in the broader modular system include options other than the articulating toothed arrays described within this embodiment. FIGS. 28 through 30 inclusive show a range of inserts devised for compatible use with the broader ski system of the disclosure.

FIG. 28 shows a planar insert which creates a functional mode of operation resembling a conventional ski. FIG. 29 depicts a ski suitable provided with fixed teeth for aggressive climbing on sheer, icy terrain. FIG. 30 shows a particularly hardwearing embodiment of the articulating toothed array, in which all exposed of the array surfaces are metallic.

FIG. 28 shows one alternate, planar insert aligned for removable insertion into the housing. In this exemplary embodiment of the disclosure, the modular planar insert includes receptive ski subassembly 1100 organized for use with modular grooved planar insert 1300.

When in place in the provided housing, modular grooved planar insert 1300 emulates the functional effect of a conventional, continuously level ski base, at each location having a substantially flat surface with a central concave tracking channel.

This planer configuration may be desired in critical aggressive or extended downhill skiing sessions, or, for example, when skiing in any athletic session in which reverse skiing is to be practiced. It may also be preferred and temporarily installed when rotating, aerial, or balletic maneuvers are anticipated in the skiing session.

Accordingly, this modular kit includes modular grooved planar insert 1300 having intermittent perimeter wall 1302 formed thereabout. Modular planar insert leading end retention fittings 1304 and modular planar insert side edge retention fittings 1306 provide means of reversible attachment. Modular planar insert directional indicia 1308 provide visual confirmation of correct orientation.

Modular planar insert longitudinal tracking groove 1314 is devised to be geometrically continuous with modular traction modular insert housing concave recess 1128 and ski base concave groove 1162.

Modular planar insert tool access slots 1316 formed through modular planar insert external face 1320 minimizes surfaces the aperture areas of the two slots, but provides sufficient mechanical purchase that the insert may be readily lifted from the housing. The dual slots allow symmetrical lifting, but also provide redundancy in case of chipping or breakage of one side. During installation, modular planar insert perimeter bevel 1122 meets planar insert reverse bevel 1318 and substantially seals the insert perimeter against any unwanted incursion of snow, ice, or water.

Just as a skier may encounter extended declination, so a skier may encounter extended inclinations having hard, icy surfaces. Such surfaces are mechanically incompliant to any texture or surface carried upon the ski. Such icy terrain may be encountered owning to seasonal variation, or to persistent glacial or alpine conditions.

FIG. 29 is a partially exploded view illustrating the installation of a fixed, metallic toothed array with a geometrically interfitting, monolithically molded exclusion pad. The fixed toothed array provides a secure grip on challenging, slippery inclines, while the polymer fill pad excludes the invasion of ice particles into the interior hollows of the raised teeth.

While modular fixed-tooth insert exclusion pad 1400 is technically optional, it has been found useful in common circumstances where ice accumulation might reduce the effectiveness of the raised, formed steel teeth. Crystals of snow or ice are to some extent adhesive to one another, and an accumulation of such crystals within hollow teeth can permit the formation of local convexities ahead of the engagement feature of the teeth.

Such convexities of accumulated ice can deter the sharp teeth from having the desired reliable grip upon sheer ice. In the illustrated embodiment, the sharp edges of the teeth are left exposed and slightly extended over the polymer insert. The remaining internal hollows in the toothed array are otherwise substantially filled by a commensurate and compatibly-designed molded polymer insert.

The geometrical integration of fixed-tooth insert exclusion pad 1400 with modular fixed-tooth insert 1500 may be understood by reference to the arrangement depicted in FIG. 29. The modular kit provided in the perspective view in FIG. 29 includes the shared feature comprising receptive ski subassembly 1100. Receptive ski subassembly 1100 includes modular traction ski body 1140 in which modular insert housing 1110 is permanently installed.

In this modular kit, the elected functional unit furthermore includes modular fixed-tooth insert exclusion pad 1400 and modular fixed-tooth insert 1500. Modular fixed-tooth insert 1500 may be formed using sheets of 28-gauge, type 304 stainless steel. An aperture, metal blank may be etched using resists on the front, back, or both, in such a way as to result in a beveled or so-called hollow edge.

In these details and descriptions, a bevel is generally taken to be a relatively narrow surface feature having a linear angle, while a hollow edge is understood to be relatively narrow an edge having a concave sectional profile. However, it is appreciated the excluding function of mating perimeter bevels, for example, can be served equally by a stepped, curved, or convoluted perimeter.

Analogously, it is understood that, while a hollow edged tooth may be preferred, that the disclosure includes embodiments with straight, angular bevels formed upon the teeth. In general, such details should be construed as having been provided within this description in order to establish enablement, and to disclose specific, practical implementations of the disclosure, rather than to set out limitations upon the disclosure's intended forms or modes of use.

Accordingly, within the disclosure, any desired type of tooth, edge, surface feature, or fitting may be created by etching, punching, stamping, forging, folding, rolling, forming or grinding, or a combination or progression of these methods. Progressive dies may be employed, for example, for the formation of tabs and bevels. Heating of the metal blank in advance or during forming can be useful in reducing cracking or subsequent premature fatiguing of formed metal features.

The practical utility of a particular design in a given skiing session is elective. For example, a beveled edge is conventionally assumed to be more durable, while a hollow edge might be elected to provide more aggressive purchase on sheer ice faces. Lower-profile teeth would be preferred for sheer ice, whereas, in challenging "dust-on-crust" conditions, in which a shallow powder layer covers an icy surface, more elevated teeth might be preferred in order to penetrate the superficial deposit of loose snow powder.

Referring now to FIG. 29, modular fixed-tooth insert 1500 includes fixed-tooth insert intermittent perimeter wall 1502. Modular fixed-tooth insert leading end retention fitting 1504 and modular fixed-tooth insert side edge retention fitting 1506 provide attachment means between the ski body and the insert.

Modular fixed-tooth insert directional indicia 1508 indicate the correct orientation of the metal insert. Fixed-tooth insert tracking groove 1514 runs along the midline of the insert. Modular fixed-tooth insert tool access notch 1516 permits easy removal of the insert. Fixed-tooth array 1510 comprises a plurality of fixed teeth 1512 disposed in a pattern within fixed-tooth insert 1500 and raised above fixed-tooth insert planar surface 1520.

The mechanical forming of the plurality of fixed teeth 1512 out of an apertured blank leaves fixed-tooth apertures 1522 open in fixed-tooth insert external surface 1520. Modular fixed-tooth insert external face 1520 is substantially continuous with the flat regions of the remaining ski base, while modular fixed-tooth insert longitudinal tracking channel 1514 is substantially continuous with the medial concave groove of the remaining ski base. Upon removable installation of the fixed-tooth insert, modular fixed-tooth insert perimeter bevel 1518 meets modular insert housing perimeter bevel 1122.

Modular fixed-tooth insert exclusion pad 1400 includes substantially flat modular fixed-tooth exclusion pad upper face 1420, and cylindrically concave modular fixed-tooth exclusion pad longitudinal tracking channel 1414. Modular fixed-tooth exclusion pad tool access notch 1416 allows room for a removal tool to be inserted.

Modular fixed-tooth exclusion pad perimeter bevel 1418 allows the exclusion pad to be snapped in place and mechanically retained within the underside hollow of formed metallic fixed-tooth insert 1500.

Modular fixed-tooth exclusion pad tooth fill array 1410 includes a plurality of exclusion pad tooth fills 1412. Each exclusion pad tooth fill 1412 is dimensioned to bear against the underside of one corresponding raised teeth so as to substantially fill its internal volume. Modular fixed-tooth exclusion pad aperture fill 1422 volumetrically occupies the apertures out of which the teeth were raised, and yields a surface locally coplanar with modular fixed-tooth exclusion pad upper face 1420.

While modular fixed-tooth exclusion pad aperture fill 1422 and exclusion pad tooth fill 1412 are described here as discrete features, it may be appreciated that their conjoint and cooperative displacement functions can be fulfilled by either continuous or discontinuous geometrical volumes. Namely, the two surfaces may be filleted, radiused, or geometrically integrated, and the effect advantageous so long as their detailed geometry is successful in diverting the accumulation of unwanted frozen or other potentially fouling material.

In the operation of the illustrated embodiment, it is envisioned that exclusion pad 1400 would be provided to the customer securely preinstalled in modular fixed-tooth insert 1500. That modular package is then installed within modular insert housing 1110, using the tilting insertion motion previously described. The physically discrete components may nevertheless be independently replaced or exchanged for other parts, irrespective of whether the parts have properties identical to, or dissimilar with, the component being removed.

In the disclosure, variations and advancements are envisioned which integrate various previously described aspects of the disclosure. FIG. 30 is a partially exploded view illustrating a metal-faced insert with a flush over plate, an active, metal tooth array, and a compatibly-formed fill plate. This exemplary modification therefore may be seen as combining many of the functional benefits of previously detailed embodiments, while guaranteeing an especially robust and wear-resistant performance.

It may be seen that the three elemental components of this variation nevertheless fit into the same housing recess provided in previous embodiments of the modular skiing system. Accordingly, a metal-faced active insert kit formed in accordance with disclosure therefore encompasses receptive ski subassembly 1100, modular metallic tooth resilient fill plate 1600, modular articulating metallic tooth plate 1700, and modular metallic cover plate 1800.

Modular metallic tooth resilient fill plate 1600 fills the hollow volume within modular articulating metallic tooth plate 1700 in a fashion analogous to the relationship previously considered in reference to the fixed-tooth modular system depicted in FIG. 29. Modular metallic tooth plate 1700 commensurately fills modular metallic cover plate 1800.

In this instance of the disclosure, therefore, modular metal-faced cover plate 1800 receives modular articulating metallic tooth plate 1700 into its hollow underside, while modular articulating metallic tooth plate 1700 in turn receives modular metallic tooth resilient fill plate 1600 into its hollow underside.

Metallic cover plate 1800, having cover plate matrix 1820, is provided with a plurality of metallic cover plate apertures 1822. Articulating metallic tooth array 1710, formed within modular articulating metallic tooth plate 1700, encompasses a periodic arrangement of individual articulating metallic teeth 1712.

Specifically, metallic tooth array 1710 encompasses a periodic arrangement of individual articulating metallic teeth 1712 that are effectively commensurate with locations of metallic cover plate apertures 1822.

Metallic tooth resilient fill plate 1600 includes a plurality of raised features that fill the voids within individual articulating metallic teeth 1712. Articulating metallic teeth 1712 may be raised in their forming to an elevated default deflected position so as to natively impart spring force against metallic cover plate 1800 when functionally joined with the cover plate. Alternately, spring force may be provided solely, or in combination with, metal-faced tooth resilient fill plate 1600.

These three components are mechanically interfitted into a subassembly, for example, by a pressure-, friction- or interference-fit. They may also be devised to be held together by integrally-formed metallic fastening means, such as clips or tabs, or may be joined through the use of adhesive. Irrespective of the elected process, the exemplary kit may be configured that the three components of the insert subassembly are provided to the customer as a stable, convenient, and integrated functional package.

In the illustrated case, modular metallic cover plate 1800 is devised with the fastening means to removably entrap and hold modular metallic tooth plate 1700 and modular metallic tooth resilient fill plate 1600 within modular insert housing 1110. To that end, modular metallic cover plate 1800 includes modular metal-faced cover plate leading-edge tabs 1604 and modular metallic face plate side tabs 1606. Modular metallic face plate directional indicia 1608 identifies the correct orientation of the modular part.

Modular planar metallic face plate matrix 1820 defines a lattice between a plurality of modular metallic face plate rectangular apertures 1822. Modular metallic face plate concave tracking channel 1814 is formed along the medial centerline of the cover plate. Modular metallic face plate concave tracking channel 1814 is geometrically continuous with modular traction ski base concave groove 1162. Each of these cylindrical concavities extends, for a certain period, along the length of the bottom of the ski.

Modular metallic face plate removal tool slot 1816 allows the parts to be freely lifted from the housing during removal and replacement. Modular metallic face plate reverse bevel 1818 provides tight seating against modular insert housing perimeter bevel 1122 on the preinstalled receptive housing.

Modular metallic tooth plate 1700 includes modular metallic tooth plate perimeter wall 1702, modular metal-faced tooth plate leading-edge tabs 1804, and modular metal-faced tooth plate bypass notches 1706. Modular metal-faced tooth plate planar matrix 1720 surrounds a plurality of articulating metallic teeth 1712.

In the illustrated embodiment, the cantilevered metal teeth are substantially rectangular, and are freed from the matrix on three sides by the conscientious processing of the metal sheet. A forming stage then raises the teeth, while leaving tabs or flanges on the long sides, here exemplified by metal tooth-limiting side extensions 1716.

After installation of modular metallic cover plate 1800 over modular metallic tooth plate 1700 in modular insert housing 1130 metal tooth-limiting side extensions 1716 bear against the internal face of metallic cover plate 1800. The cover plate therefore serves as the means to limit the outward travel of the formed metal teeth. Modular metallic tooth plate concave tracking channel 1714 conforms to the commensurate cylindrical channel features following the medial centerline along the length of the ski.

As in the system shown in FIG. 29, modular metal-faced tooth includes a resilient fill plate. Metallic tooth resilient fill plate 1600 may be made, for example, of rubber, silicone, polymer foam, or polymeric elastomer. In this instance, metallic tooth resilient fill plate 1600 may be used to support or enhance the spring-loading of the teeth, and may be cooperatively designed to customize the retraction resistance of the raised teeth.

It may be appreciated that the election of a particular resiliency in the material allows the tailoring the response of the articulating tooth array to the particular use and user. The resilient fill plate may be elected to have a constant resilience, or may be intentionally selected to vary in response over a parametric thermal range.

Metallic tooth resilient fill plate 1600 may be molded as a continuous solid part. Accordingly, the component shown in the accompanying figure includes metallic tooth resilient fill plate is a monolithically-formed body, including modular metallic tooth resilient fill plate planar grid 1620, and a plurality of modular metallic tooth resilient fill plate tooth reliefs 1612.

Modular metallic tooth resilient fill plate concave tracking channel 1614 conforms to the convex underside of the corresponding regions of metal-faced tooth plate 1700, namely, metallic tooth plate concave tracking channel 1714. Metallic tooth plate concave tracking channel 1714 substantially conforms to the internal side of metallic face plate concave tracking channel 1814 formed on metallic cover plate 1800.

In the operation of the embodiment of the disclosure shown in FIG. 30, it may be understood that all contact surfaces of the installed modular subassembly present a metallic face to the surfaces over which the skier travels. This embodiment is particularly suited to extreme or highly variable terrain, including those including rock formations and other natural obstacles.

While the self-articulating property of devices and systems formed according to the disclosure is appreciated, it may also be valuable in certain circumstances to subvert or otherwise regulate the self-activating nature of the toothed arrays. Accordingly, FIG. 31 and FIG. 32 schematically show systems in which the articulating array can be fixed in a given articulating condition.

Figure 31:
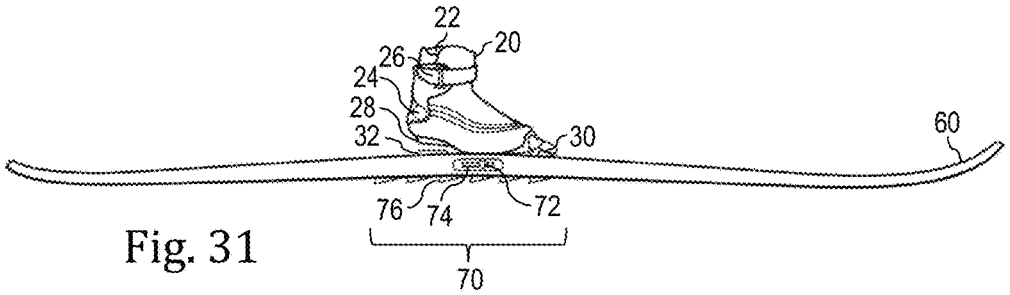
FIG. 31 is a side view illustrating a self-articulating tooth array with a lockable traction system using a side-mounted linear activation mechanism.
Figure 32:
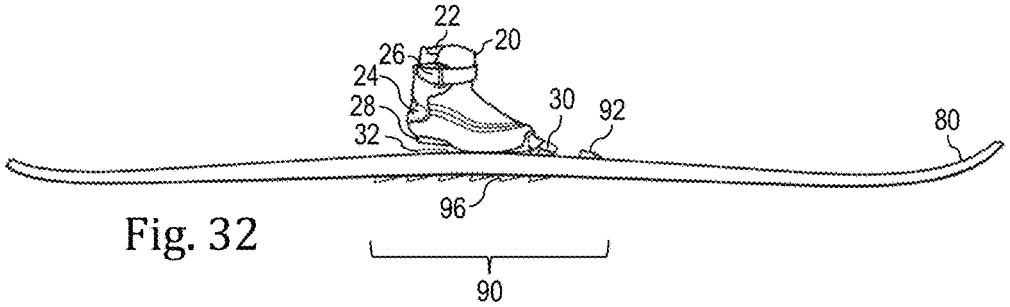
FIG. 32 is a side view illustrating a self-articulating tooth array with a lockable traction system using a top-mounted rotary activation mechanism.

FIG. 31 is a schematic side view illustrating an active tooth array with a lockable traction system using a side-mounted linear activation mechanism. FIG. 32 is a schematic side view illustrating an active tooth array with a lockable traction system using a top-mounted rotary activation mechanism. The boot and binding are independent of the lockable traction systems, and are therefore enumerated as in FIG. 2 and FIG. 3.

It may be understood by general reference to mechanical systems that linkages may be variously made by levers, slides, guides, bars, pins, holes, slots, gears, wheels, eccentrics, cams, racks, pinions, detents, stops, or pantographs to remotely activate and secure a simple linear action. While such means are envisioned as widely useful within the disclosure, their variety precludes the full range of solutions from being included in this specification.

Accordingly, the diversity of means of imparting linear motion, or converting rotary to linear motion, are incorporated by general reference, and the schematic examples represented here should be taken to be emblematic. Relative linear motion of the relevant, activated components is detailed in FIGS. 33 through 35 inclusive. An understanding of the structural relationship and operation of locking modifications may be appreciated by concurrent reference to those detailed figures.

The linear actuation system illustrated in FIG. 31 identifies a linear actuation lockable traction ski system 60, which includes linear actuation lockable traction ski module 70. Linear actuation lockable traction ski module 70 includes linear actuation lockable activator 72. Linear actuation lockable activator 72 is a manually accessible raised tab which overlies and mechanically communicates through linear actuation lockable activator slot 74. A linkage, not shown here, provides mechanical means to extend and lock linear actuation lockable activator extensible tooth array 76.

Alternatively, the rotary actuation system illustrated in FIG. 32 includes a knob or dial which may be turned to lock the teeth in a raised position, or, reversibly, free them for passive activation. Rotary actuation lockable traction ski system 80 includes actuation lockable traction ski module 70, within which mechanical communication has been made by rotary actuation lockable activator knob 92 by a linkage, not shown here, to the rotary actuation extensible tooth array 96. Rotary actuation lockable activator knob 92 provides sufficient mechanical advantage to impart linear motion to rotary actuation lockable activator extensible tooth array 96. In either case, the activation controller may be scaled and textured to be amenable to activation by a gloved hand.

Figure 33:
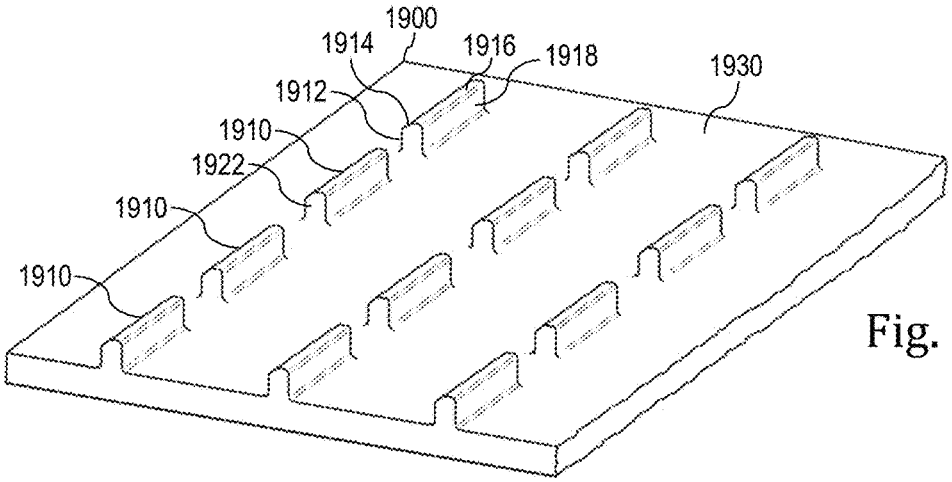
FIG. 33 is an oblique perspective view illustrating a control plate for use with a self-articulating tooth array having a lockable traction system using a sliding activation mechanism.

Irrespective of the mode of manual activation, the lifting of the teeth into a stable, locked state is, within the present disclosure, imparted through the employment of an array of ramped relief features disposed upon a plate underlying the toothed array. FIG. 33 is an oblique perspective view illustrating a control plate for use with an active tooth array having a lockable traction system.

The illustrated embodiment of a lockable traction system employs a sliding mechanism that prompts the lifting of the teeth into a locked state. Control plate 1900 may be guided or constrained by grooves or tracks formed in associated components. However, although its motion is linear, it should be understood that the motion of the control plate can be imparted by connection via either the linear linkage shown in FIG. 31, or via the rotary linkage shown in FIG. 32.

Lockable actuation control plate 1900 includes a plurality of lockable actuation control plate raised bars 1910 corresponding to the period and spacing of the corresponding tooth array. Lockable actuation control plate raised bars 1910 are defined by control plate bar lead face 1912, control plate bar sloped face 1914, control plate bar top face 1916, and control plate bar back face 1918, and lockable actuation control plate raised bar end face 1922. The preponderance of the external area of the lockable actuation control is planar, as characterized by control plate planar outward face region 1930.

The control plate may be amenably formed of a section of extruded aluminum, which has been milled or machined to remove spaces between the raised bars. It may alternately be molded or otherwise fabricated of any suitable, durable polymer.

Figure 34:
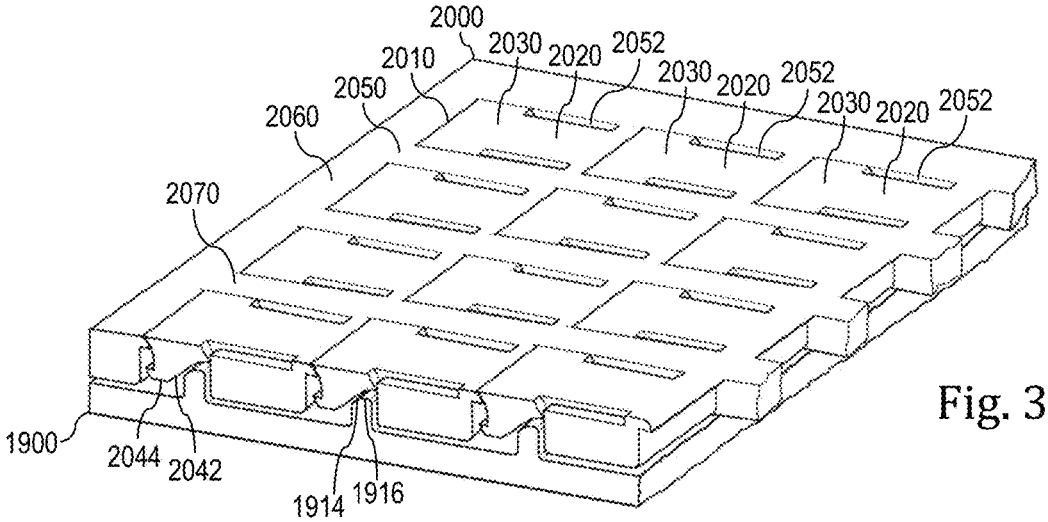
FIG. 34 is an oblique perspective view illustrating a control plate and compatible tooth array forming a lockable traction system through the use of a sliding activation mechanism, showing the deflectable teeth pressed into their retracted position.

FIG. 34 is an oblique perspective view illustrating a control plate and compatible tooth array forming a lockable traction system through the use of a sliding activation mechanism, showing the deflectable teeth pressed by an external force, such as that imparted by the weight of a skier against a snow-covered slope, into their retracted position.

It may be seen that, with the control plate in this housed position, the toothed array is unaffected by the presence of the control plate, and acts in the self-articulating manner described in previous embodiments. The manner by which the hinged teeth are electively raised and kept in a stable, elevated position by the control plate may be understood by reference to FIG. 35.

Figure 35:
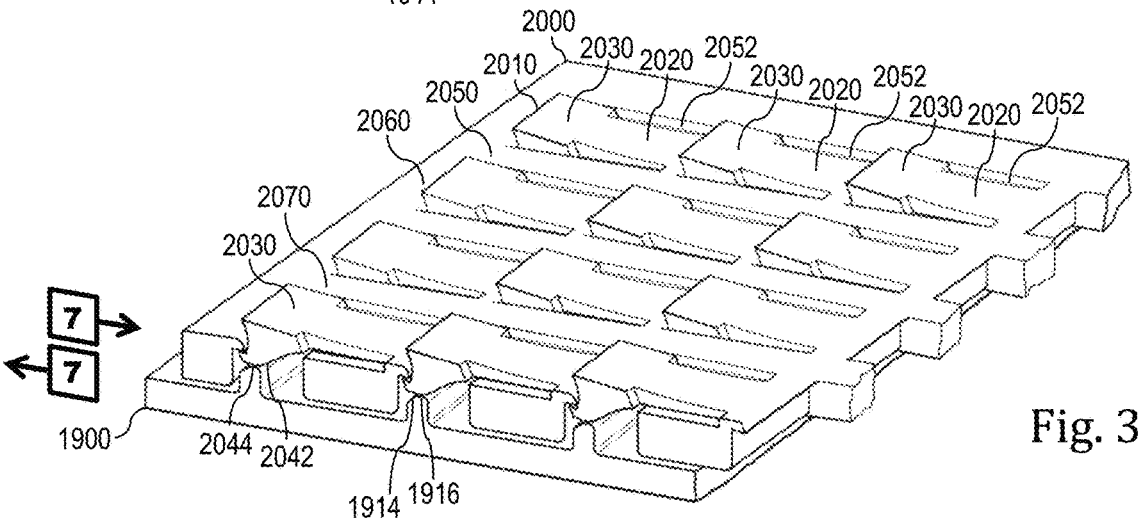
FIG. 35 is an oblique perspective view illustrating a control plate and compatible tooth array forming a lockable traction system through the use of a sliding activation mechanism, showing the deflectable teeth being prevented by the relative linear displacement of the control plate from retreating into their otherwise attainable retracted tooth position, thereby allowing two distinct and electable modes of use.

FIG. 35 is an oblique perspective view illustrating a control plate and compatible tooth array forming a lockable traction system through the use of a sliding activation mechanism, showing the deflectable teeth pressed into a reversibly fixed and raised position. The figure shows the deflectable teeth being prevented by the relative linear displacement of the control plate from retreating into their alternate, retracted tooth position. This alternation allows, in this embodiment of the disclosure, two distinct and electable modes of use.

It may be appreciated by reflective reference to FIG. 4, FIG. 6, and FIG. 7, that lockable array tooth plate 2000 is structurally interchangeable with the form thrust-adaptive relief module 100, and that there is little deviation from a shared foundational concept.

Referring now collectively to the detailed drawings, the lockable actuation system shown incorporates lockable actuation control plate 1900 and lockable array tooth plate 2000. Each lockable array deflectable tooth 2010 includes lockable array tooth beam 2020 and lockable array tooth head 2030. Lockable array ramp face 2042 is formed at an angle on the internal side of each lockable array deflectable tooth 2010. Lockable array rest face 2044 is formed substantially parallel to the major plane of the array.

Lockable array matrix 2050 provides a supporting grid for the array of lockable teeth, and includes lockable array transverse bars 2060 and lockable array longitudinal bars 2070. The planar surface of the external matrix is locally interrupted by lockable array recessed beam release channels 2052. Lockable array recessed release channels 2052 permit the separation and independent movement of the beams relative to their surrounding matrix.

Actuation of the locked mode occurs when the control plate is displaced longitudinally in a plane parallel to the plane associated with base of the ski. As the control plate is moved from a first position, in which it occupies voids in the underside of the toothed array, to a second position, in which it occupies voids intermittently occupied by the teeth when in their retracted state, the teeth become effectively locked in their elevated locations.

Referring particularly to FIG. 35, the inducement of relative motion in the direction indicated by the two opposing directional arrows 7 causes control plate bar sloped face 1914 to bear first against lockable array ramp face 2042, lifting the tooth progressively into a raised position.

As control plate bar sloped face 1914 bypasses lockable array ramp face 2042, control plate bar top face 1916 comes to bear on the flat surface of lockable array rest face 2044. Lockable actuation control plate raised bars 1910 are conscientiously devised to force lockable array deflectable teeth 2010 into a stable, locked position across the array.

The teeth may be locked when the skis are separate from the user, and the teeth are in their default raised position. It is nevertheless a feature of the disclosure that, because the control plate ramps against the internal face of the teeth, that the teeth may be raised over some degree of externally applied loading. The teeth may therefore be raised and locked while the skier is in a standing position on the skis, and the skis need not be removed to alter the mode of operation. The raising action can also be momentarily activated to clear or de-ice a toothed array.

It may also be appreciated that a control plate may alternately include an array of tapered hooks or pins that engage compatible surfaces on the tooth heads and draw them down into a retracted position. The hooks or pins can pass through the compatibly formed slots in the transverse bars of the matrix to meet and mechanically engage with the heads of the teeth.

It may readily be imagined that these operational features may be encompassed in a single system, and the control plate may be variously devised to raise, lower, or free the teeth within the same assembly. Actuating the plate motion in one direction would keep the teeth raised, while actuating it in the other would lock the teeth in their flush position. A central position of the plate would permit the teeth to passively articulate according to the skier's motion and muscular activity.

In such envisioned extensions of the disclosure, the teeth may be deployed is the unregulated, self-articulating mode, but may also be set to provide any degree of fixed or limited extension or retraction. Arrays formed in accordance with the disclosure can therefore be adjusted on-the-fly for changing conditions or functional preferences.

FIGS. 36 through 45 inclusive show an embodiment of the disclosure in which a jointed housing is used in combination with a compatible jointed insert. The jointing of the parts provides the components with increased flexibility so that they can adapt freely and conformally with alternations of the ski camber during active use.

The jointed housing incorporates a molded part formed of polymers having dissimilar mechanical properties, so that regions of the part are relatively rigid, while other regions are relatively elastic. This result may be attained through over-molding of a rigid polymer with a thermoplastic elastomer.

The use of over-molding may be generally understood to be within the scope application of the disclosure. The following example illustrates some integrated functions of over-molding within the jointed housing. It should be appreciated that over-molding may also be used within, for example, a toothed array, and that the location and use of regions locally filled with elastic material is taken as a pervasive design option within the reach of the disclosure. For example, each raked tooth may be provided with an individual elastomeric gasket.

Envisioned functionalities enabled by localized thermoplastic elastomer over-molding include snow, ice, and water ejection; snow, ice, and water exclusion; component elasticity; tooth resilience; sealing, gasketing, and waterproofing; gripping and holding; as well as shock absorption, vibration reduction, and acoustic damping.

Figure 36:
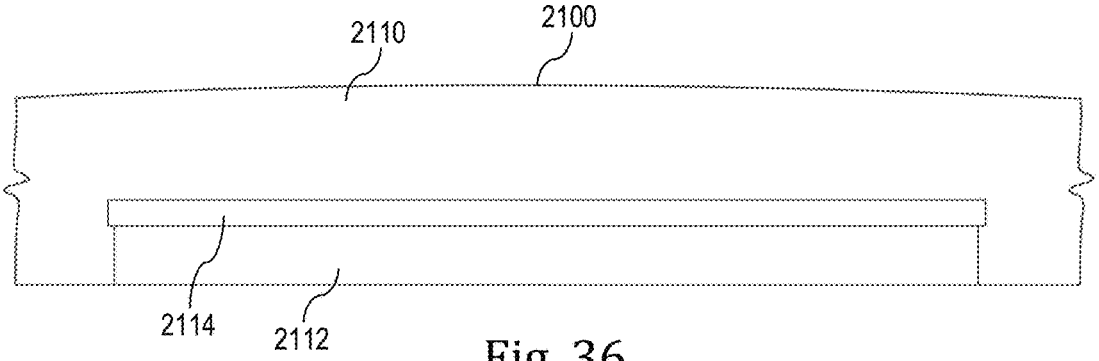
FIG. 36 is a partial cutaway view of a ski held flat and provided with an undercut installation recess.

Returning now to the drawings, FIG. 36 is a schematic partial cutaway view of cambered ski 2100 having cambered ski body 2110 that is held flat and provided with undercut installation recess 2212. Installation recess 2212 includes undercut internal perimeter 2214.

Undercut recess 2112 may be formed either by milling with an integral T-slot bit, or through the use of a progressive sequence of bits. The cavity may also be formed during the lay-up of laminations, or may be the result of a combination of such techniques.

The undercut recess is designed to receive an array of snap fittings formed on a plastic housing devised to be permanently installed in cambered ski body 2110. The plastic housing, in turn, reversibly receives base components within the range previously exemplified in earlier figures.

Figure 37:
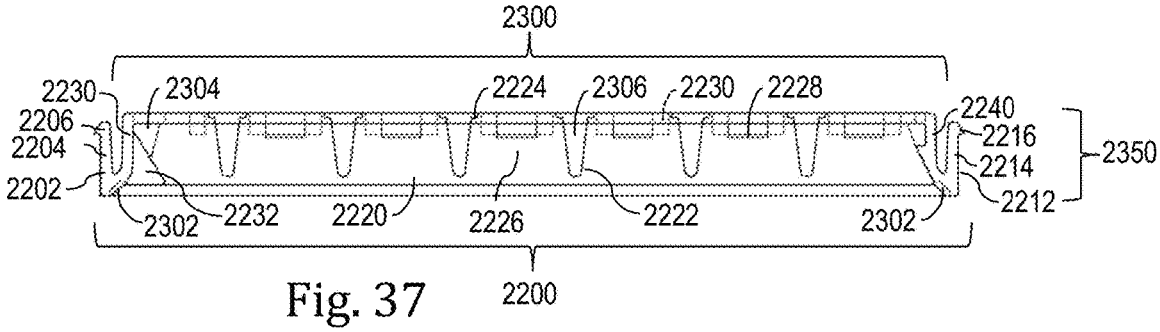
FIG. 37 is a cutaway view of a molded, jointed housing which may be permanently installed in the recess of the ski illustrated in FIG. 36.

Accordingly, FIG. 37 is a cutaway view of molded, jointed insert housing armature 2200. Jointed insert housing armature 2200 is formed integrally with thermoplastic elastomer infilling 2300 by the process of injection-molding of a relatively rigid polymer followed by over-molding with thermoplastic elastomer.

In such processes, a progression of geometrically-associated mold cavities allows the introduction of dissimilar polymers into an integral molding sequence. Edges where the dissimilar materials meet may be strengthened by the use of tapering, corrugation, stepping or lapping. The conjunction of insert housing armature 2200 and thermoplastic elastomer infilling 2300 through over-molding forms over-molded insert 2350. Accordingly, over-molded insert 2350 encompasses locally varied material properties.

Jointed insert housing 2200 includes housing leading edge latch 2202, which includes housing leading edge catch beam 2204 and housing leading edge catch 2206. Jointed insert housing 2200 also includes housing trailing edge latch 2212, which in turn includes housing trailing edge catch beam 2214 and housing trailing edge catch 2216.

Jointed housing sidewall 2220 is interrupted periodically by housing sidewall clefts 2222, which are formed on opposing sidewalls, and are connected transversely by step-sided slots 2224. Housing sidewall clefts 2222 define sidewall tabs 2226. Sidewall indent catches 2228 are formed into the sidewalls, and are beveled to encourage the release of installed inserts.

External sidewall catches 2230 extend from the exterior of each sidewall tab 2226, and are dimensioned to occupy, once installed, undercut internal perimeter 2214.

Leading edge end wall 2230 incorporates a plurality of housing alignment fins 2232, which extend perpendicularly from the internal face of the end wall. Trailing edge end wall 2244 incorporates trailing edge insert catch 2236.

Elastomer infilling 2300 includes perimeter gasket 2302, corner infills 2304, and transverse infills 2306. Perimeter gasket 2302 allows the juncture of the housing and an insert inserts to seal out moisture. Corner infills 2304 allow the sidewalls to deflect inward during installment of the housing in the ski, while and transverse infills 2306 allow the housing structure to attain a sort of vertebral flexion during the reciprocating skiing activity cycle.

Figure 38:
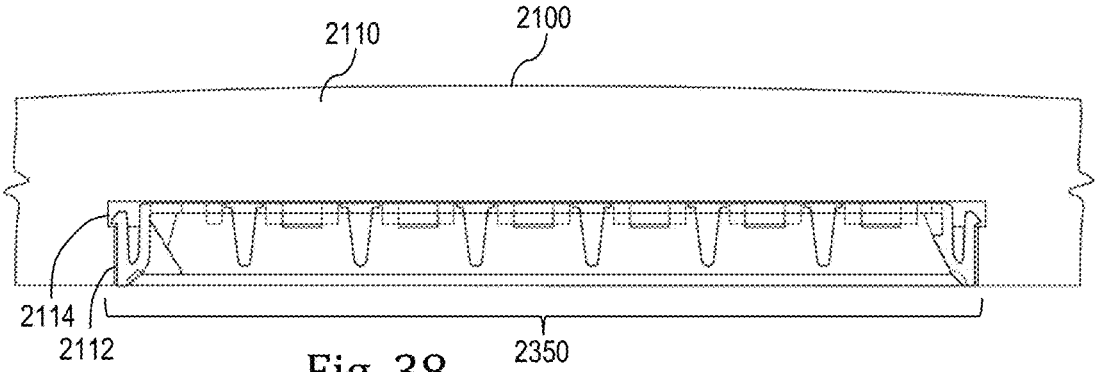
FIG. 38 is a cutaway view of the ski with the jointed housing installed, in which the ski is kept flat.

FIG. 38 shows a cutaway view of the ski with the jointed housing installed. In this view, the ski is held flat. It may be seen that the external catches are received by undercut internal perimeter 2214, so that jointed insert housing 2200 is permanently retained in the recess within cambered ski body 2110. A flexible adhesive may electively be used in conjunction with this installation.

Figure 39:
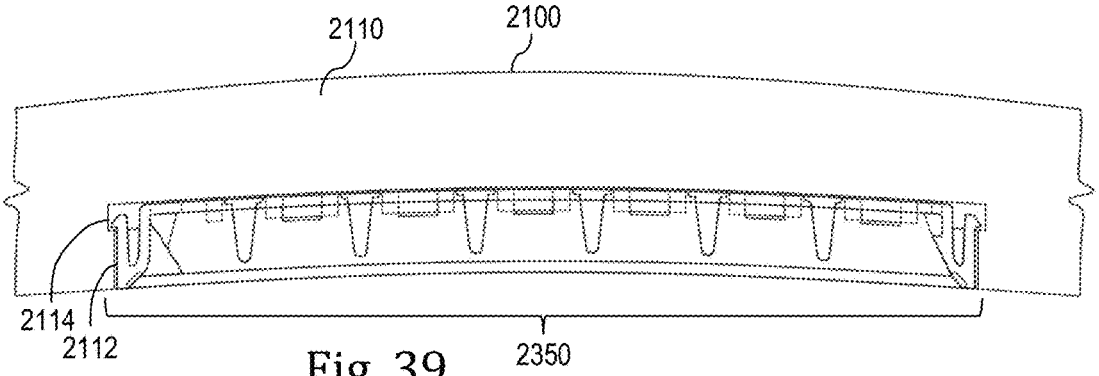
FIG. 39 is a cutaway view of the ski with the jointed housing installed, in which the ski body has been allowed to return to its default, cambered state.

FIG. 39 is a cutaway view of the ski with the jointed housing installed, in which the ski body has been allowed to return to its default, cambered state. It may be appreciated that external sidewall catches 2230 engage firmly with undercut internal perimeter 2214, but are not completely constrained in their longitudinal position. This condition allows the housing to accommodate the repeated flexure of the ski without releasing from installation recess 2212.

Figure 40:
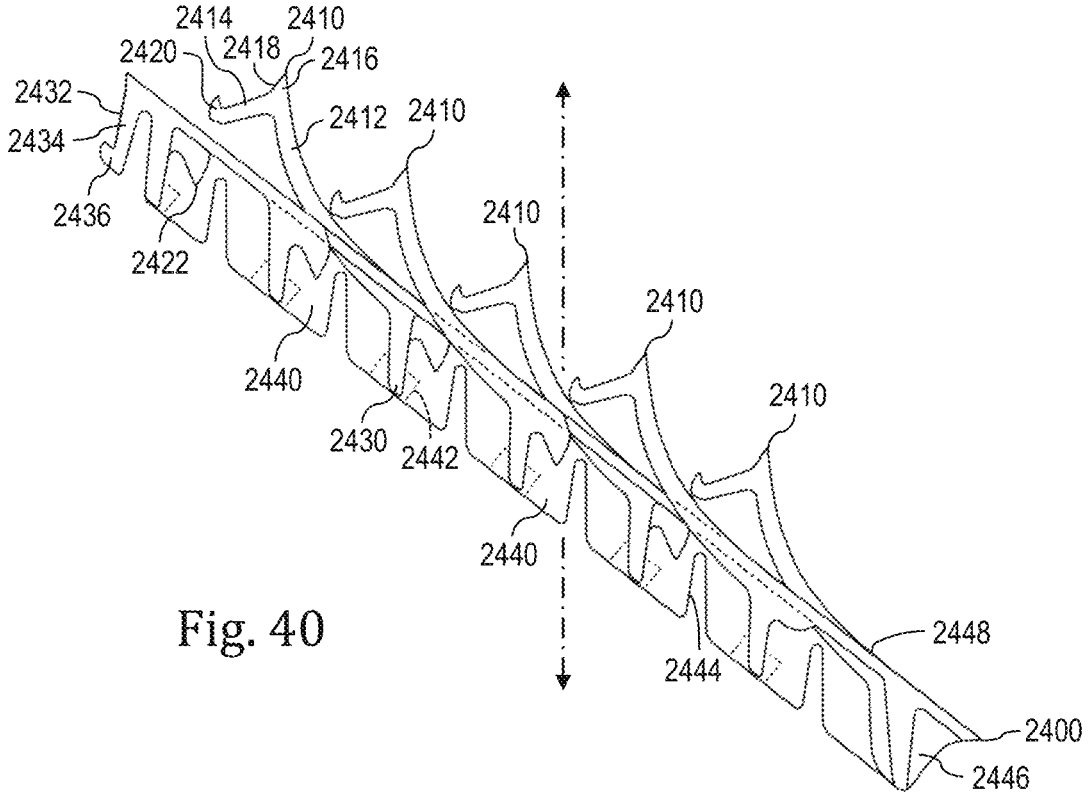
FIG. 40 is a cutaway view of a jointed, toothed array devised to be molded at a parting angle of approximately 35°.

FIG. 40 is a cutaway view of a jointed, toothed array devised to be molded at an unconventional cavity angle. The angular offset is elected in consideration of functional mold features such as the tooth rake and the face angle of the tooth catches. In the illustrated example, the design allows ejection at cavity angles between approximately 30° to 40°.

A 35° cavity angle, for example, allows both an aggressive tooth rake and an irreversible positive hook in the tooth catch, and provides no undercuts that would complicate the mold operation, or interfere with extraction of the part. The axis of mold parting is indicated by the two opposing arrows in FIG. 40.

Returning now to the detailed drawing, jointed insert 2400 includes a plurality of raked teeth 2410 provided in a staggered arrangement. Each tooth includes primary tooth beam 2412, secondary tooth beam 2414, raked tooth 2416, raked tooth face 2418, and secondary beam hook 2420. Jointed insert catches 2422 are devised to compatibly engage with secondary beam hooks 2420. Sloped ribs 2430 integrate jointed insert catches 2422.

At the leading edge of the part, insert leading edge fastener 2432 includes fastener beam 2434 and fastener hook 2436. A void behind insert leading edge fastener 2432 allows deflection of the insert fastener during installation and removal.

Insert side tabs 2440 include external tab catches 2442, which are scaled and tapered to readily engage with compatible sidewall indent catches 2228 formed in jointed insert housing 2200. Insert sidewall clefts 2444 are formed at an oblique angle so that their design is in keeping with the sloped cavity angle. Insert alignment fins 2446 are formed at the same spatial frequency as housing alignment fins 2232, but at opposing positional locations, in a manner such that the fins may be interlaced and inherently guide the two parts into alignment.

Break line 2450 indicates the axis along which the mold is separated. Parting line locations and mold shapes may be derived from reference to the part geometry.

Figure 41:
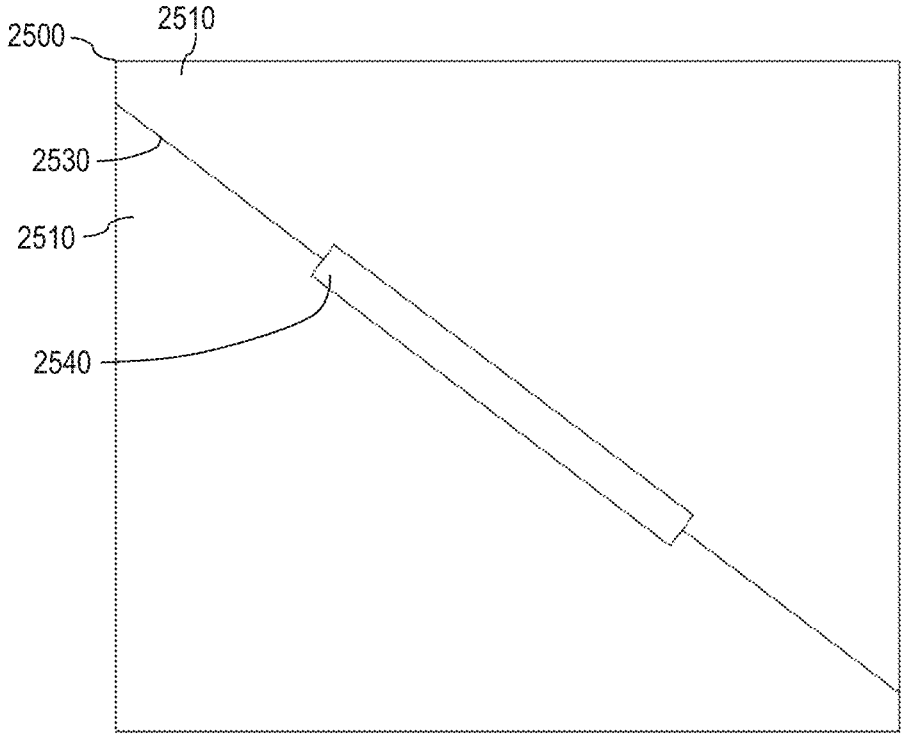
FIG. 41 is a schematic, cutaway view of the canted orientation of the mold cavity that enables easy fabrication and ejection of the part without complicating undercuts.

FIG. 41 is a schematic, cutaway view of the canted orientation of a mold cavity conceived in accordance with the disclosure. The conventional separation of mold halves places the part on a plane between and perpendicular to the machine's linear axis of separation.

In certain imaginable designs within the disclosure, this practice would either place compromising limitations on the part geometry, or necessitate complex mold designs having one or more moving mold components.

Simplicity and economy being considered generally advantageous, the disclosure provides means by which a conscientiously angled mold cavity enables easy fabrication and ejection of parts that would otherwise be difficult to cost-effectively manufacture.

This option may be appreciated by concurrent reference to the monolithic part shown in FIG. 40, and the simple diagram of a angles mold cavity shown in FIG. 41. Referring now to FIG. 41, toothed insert mold 2500 includes lower mold half 2510 and upper mold half 2520. Parting plane 2530 is formed at the pre-established angle, while mold cavity 2510 includes a complex parting line that is formed according to the local angularities of the component design, as is widely understood in the practice of injection-molding.

When economics justifies such a design, the disclosure may of course encompass the use of multi-cavity molds. Furthermore, the insert may alternately or additionally include over-molded elastomeric regions. The choice of whether elastomeric features are carried on the housing, the insert, as a discrete component, or not at all, is at the election of the system designer, and such variants are envisioned as within the scope and intent of the disclosure.

Figure 42:
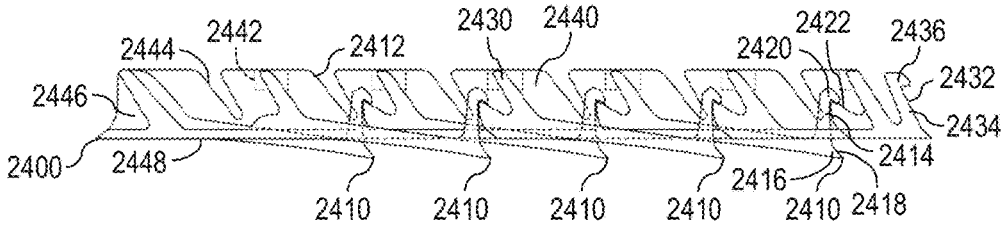
FIG. 42 is a cutaway view of the part shown in FIG. 40, after the jointed insert has been mechanically processed so that the teeth are permanently engaged.

FIG. 42 is a cutaway view of the part shown in FIG. 40, after the jointed insert has been mechanically processed so that the teeth are permanently engaged. As noted, this phase may be obtained by the application of mechanical force between the teeth surfaces and the surrounding matrix. More specifically, secondary beam hook 2418 engages with jointed insert catches 2420 and entraps each raked tooth 2410 within its recess. Each raked tooth 2410 remains in a position elevated by spring force until deflected by application of a force or surface, such as forward motion upon snow-covered terrain.

Figure 43:
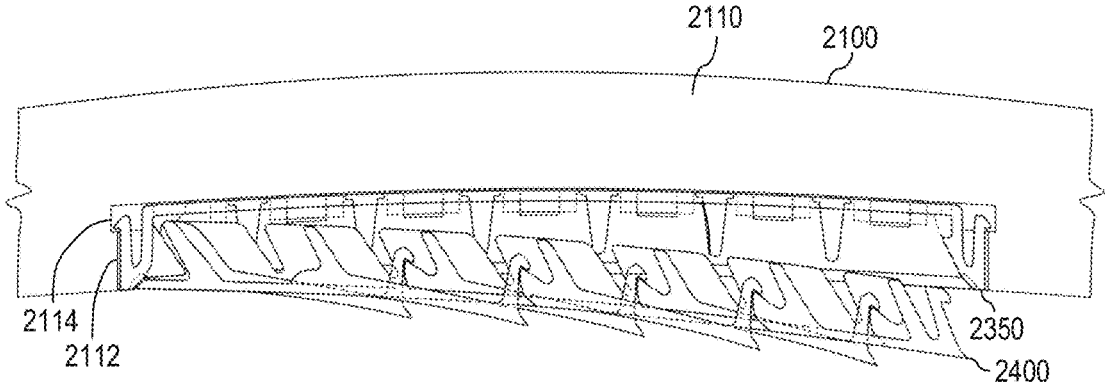
FIG. 43 is a cutaway view showing the jointed insert being flexed and positioned into the housing that has been previously installed in the recess within the ski body.

An exemplary installation and use of a removable insert are shown in FIGS. 43 through 25 inclusive. FIG. 43 is a cutaway view showing jointed insert 2400 being flexed and positioned into a housing that has previously been irreversibly installed in the recess within the ski body.

As the insert in placed in the housing, each set of fins is progressively installed in the voids between its counterparts on the companion part. Namely, housing alignment fins 2232 are progressively interleaved with insert alignment fins 2446. The fins would normally have tapered thicknesses both to facilitate mold release, and to encourage ready interleaving and registration of the parts.

Jointed insert 2400 is securely installed and held in place by the collective effect of interleaved fins, external tab catches 2442, sidewall indent catches 2228, trailing edge insert catch 2236, and insert leading edge fastener 2432. In addition, fastener hook 2436 engages with trailing edge insert catch 2236. Integral perimeter gasket 2302 forms a seal which excludes solid and liquid contaminants.

Figure 44:
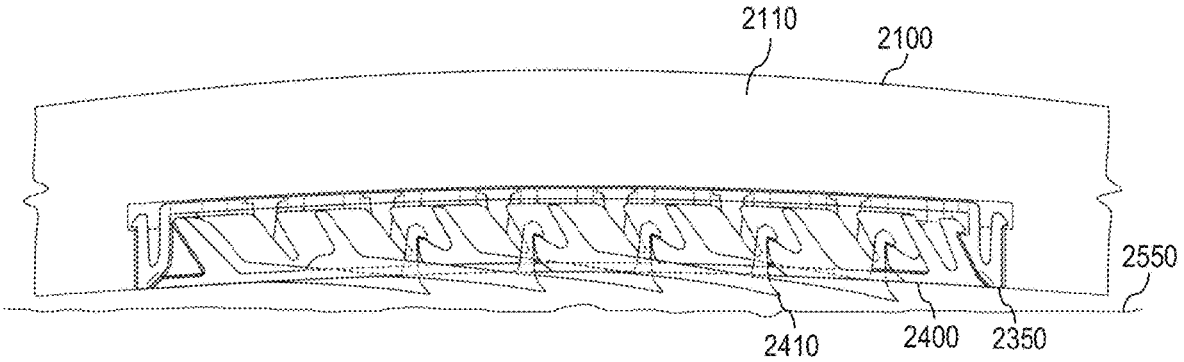
FIG. 44 is a cutaway view of the cambered ski assembly at a phase in which the teeth are held above a snow surface.
Figure 45:
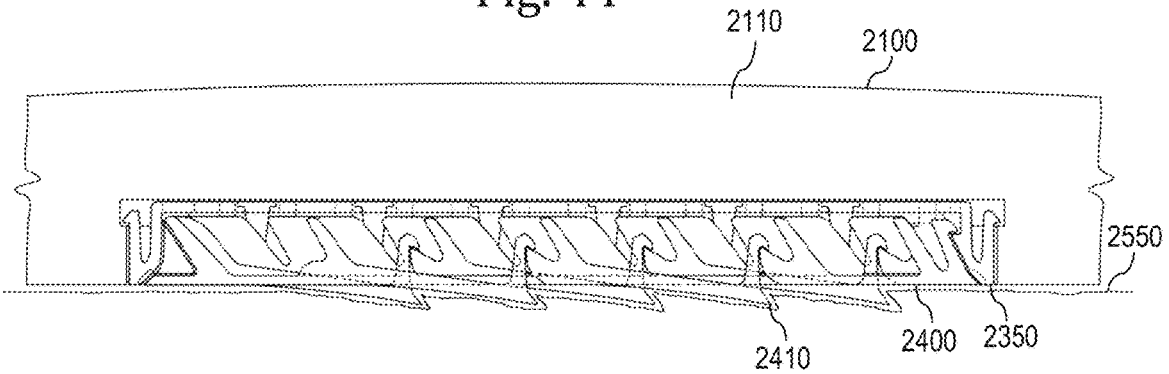
FIG. 45 is a cutaway view of the cambered ski assembly at a phase in which the camber has been rendered neutral by the application of weight and athletic force, in which teeth are engaged in a depth of snow.

FIG. 44 and FIG. 45 show two operational phases of the raked tooth insert during skiing upon snow, suggested by exemplary snow surface 2550. FIG. 44 is a cutaway view of the cambered ski assembly at a phase in which the teeth are held above a snow surface. In this phase, relatively little of the skier's weight is conveyed to the ski. The camber of the ski keeps the ski base from contact with the snow.

FIG. 45 is a cutaway view of the cambered ski assembly when the ski's camber has been rendered neutral by the application of weight and athletic force. At this phase, when rearward force is imparted to the ski, as when in forward motion on level inclined terrain, teeth are engaged in a depth of snow, and the teeth raised by the combination of spring force, tooth rake, and interaction with the particular snow composition.

FIGS. 44 and 45 together characterize a skilled technique in the practice of Nordic skiing. However, novice users often slide an advancing ski forward and back without transferring their center of gravity from one ski to the other. The result of this practice is an unsatisfactory shuffle that generates little forward progress.

By reference to FIG. 45, it may be appreciated that the raked teeth formed in accordance with the disclosure will ameliorate this experience. Since the teeth extend on reversal of motion, irrespective of whether the base of the ski is raised above the snow or in contact with it, the design depicted is relatively agnostic to the skill level of the user. The principles of the disclosure can therefore improve the performance of both the competitive technical racer, as well as the neophyte.

Figure 46:
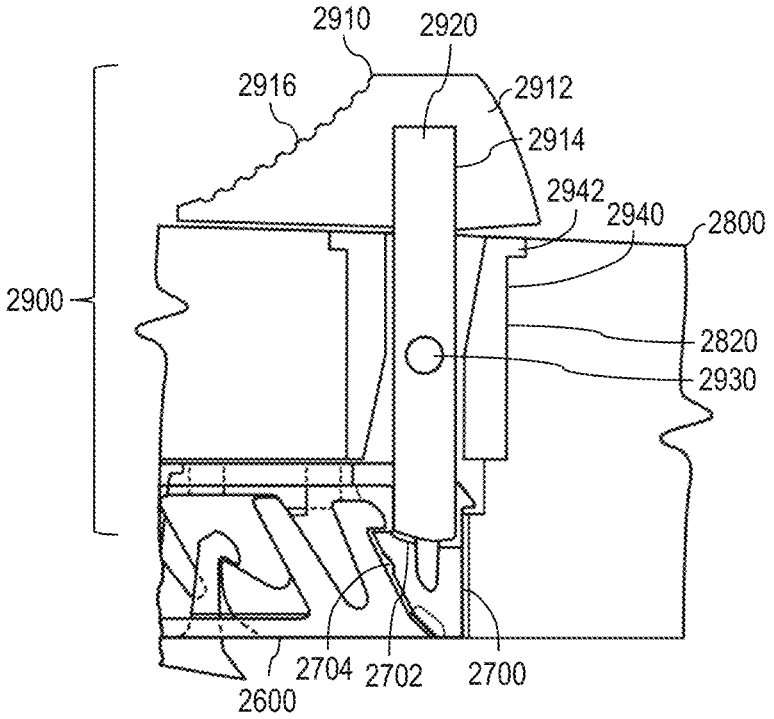
FIG. 46 is a partial cutaway view of an ejection mechanism which allows a secure installation of a jointed insert to be reversed only through intentional manual intervention.

The disclosure envisions diverse interlocks and safety features which ensure that the inserts are not unintentionally released. FIG. 46 is a partial cutaway view of insert ejection mechanism 2900 which allows a secure installation of a jointed insert to be reversed only through active manual intervention, yet which requires no external tool.

Exemplary removable insert 2600 is set in mechanically accessible housing 2700. Mechanically accessible housing 2700 resembles jointed insert housing 2200, but has additional features, including release port 2702 and soft detent 2704. Mechanical access from the top of ejection ski 2800 is provided by stepped through-hole 2820.

Release button 2910 includes button body 2912, button post-receiving hole 2914, and textured finger grip 2916. Trigger post 2920 links the top of the ski to the housing cavity, and is transversely intersected by pivot pin 2930. Ski plug 2940 includes flange 2942 and includes transverse holes to receive pivot pin 2940. Pivot pin 2940 intersects trigger post 2920 such that the post may move over a limited angular range relative to ski plug 2940.

In operation of the release button, linear force applied to release button 2910 causes trigger post 2920 to pivot about pivot pin 2940, deflecting releasable fastener hook 2602 so that removable insert 2600 is partially ejected from mechanically accessible housing 2700. Soft detent 2704 prevents the insert from inconveniently exiting the housing and falling out of the user's control. Once the insert's trailing edge is raised above the base, the insert may then be simply lifted from the housing with a free hand.

In addition to the exemplary form exhibited in FIG. 45, release mechanisms may be spring-loaded to return to a default position. They may also include one or more interlocks to definitively exclude any accidental release or loss of the insert. They may be marked to indicate the direction of activation, and their controls structurally or cosmetically integrated with linkages governing the types of control plates previously described in this specification.

It may be appreciated that the disclosure is not intended to be limited to the exemplary cases described in this specification, but may include a range of solutions which integrate or extend the text and drawings that constitute this application.

For example, the retention of an insert in its housing may be attained by mechanical, magnetic, or adhesive resistance. In each of these cases, manual release via an integrated lifting component may be employed. An integrated lever, depression, or catch may assist in releasing and lifting the module from its recess. Such envisioned alternatives obviate the need for a discrete tool in the exchange of modular components. Alternately, a dedicated tool may be housed upon or within the ski.

Inserts, sections, or regions of material formed according to the disclosure can be variously distributed upon the base of the ski. The scale, module, pattern, configuration, or composition of such materials can be varied between locations on the same ski. The scale, module, pattern, configuration, or composition of such materials can also be varied between locations within the same component.

Traction features may be subjected to random or stochastic patterning or scaling, for example, in order to improve performance, or reduce objectionable noise.

Intermediate and extrapolated versions of the disclosure may be readily imagined. For example, metal components in the present examples may be exchanged for polymer equivalents, or hybrid materials such as metal/polymer laminates may be employed. Polymers may be a component of a composite material, and may include glass, metal, or carbon fiber reinforcement. Metal or polymer foundations may be coated, clad, or plated with a different functional material.

Materials or modular inserts formed according to the disclosure may be keyed or coded in various ways to enable or disable certain uses with a given pair of skis. Materials or modular inserts formed according to the disclosure may be numbered, marked, or color-coded to identify their type and appropriate modes of use.

Resilient inserts located beneath the rigid teeth may be closed-cell or skinned foams, but may also include channeled components or open-cell foams capable of retaining and distributing liquid materials. For example, waxes, surfactants, oils, lubricants, de-icers, or anti-freezes, or combinations of the above, may be applied as aerosols to an internal open cell foam pad, either prior to or after installation of a module into a ski.

Skis or inserts may include fittings so that fluids can be admitted to the internal workings of a toothed array and distributed without the need to remove the insert. Fittings may include, valves, seals, reservoirs, or other containments to admit, reserve, and dispense such fluids to and from desired locations.

Polymer parts may be metal-plated to increase durability or enhance appearance. Metal, plastic, or metal-plated plastic parts may be coated with polytetrafluoroethylene (PTFE, Teflon) or other fluoropolymer to reduce surface resistance upon snow-covered surfaces. Metal armatures, such as those including articulating teeth, may electively be embedded in polymer by over-molding. Tooth edges in such cases may be beveled or raked according to know practices in metal manufacture.

Surfaces intended for contact with the snow may be devised to absorb or retain waxes, lubricants, surfactants, or other friction-reducing materials. For example, the inserts may be formed with a "ground" texture, typically comprising linear grooving intended to receive liquefied wax. A toothed insert may also include sintered or microporous layers that absorb liquid, viscous, or solid assistive products.

Specific operations described in this specification, such as injection molding, may be functionally reproduced by other processes such as compression molding, extrusion, or rotary production. Depending on scale or other variables, operations analogous to those herein described may be enacted through means that differ from those described.

For, example rotary impressions may be made by progressive rollers or dies, and undercuts and tooth rakes may be permitted by stacked discs having serially varied profiles. Extraction of raked teeth may be enabled by working material at pliable temperatures, or by differential roller diameters or rotation rates.

Insert molding may be used in diverse ways in combination with the disclosure. For example, metal components such as sleeves, collars, bushings, flanges, rivets, pins, grommets, or internally threaded inserts may be placed in a mold in any elected mold cycle so that the parts are structurally integrated into the polymeric part.

In general, the application of skilled and informed industrial practices may be understood to be within the envisioned scope of the disclosure.

While a single design may be acceptable for a wide variety of users and over a range of conditions, the disclosure allows for customization and wide adaptability. In view of the foregoing discussion, it may be appreciated that the optimal formula for choosing a particular articulating array design, whether fixed or modular, may include multiple, independent factors.

Accordingly, the disclosure envisions automated calculators which integrate these factors and deliver to the prospective skier an optimal configuration. For example, an application on a mobile phone may receive information regarding extant conditions from ski areas, or as forecasts from weather services. At the direction of the user, or from memory, the application may collect information from particular slopes or geographical locations.

Such information may be derived, for example, by remote sensing, by weather stations or their agents, or by reports from recent local practitioners or their informants. A software application may then factor and integrate that information with the known age, weight, athletic style, and experience of the skier. On the basis of that information, a weighted formula may be applied, and an optimal recommendation of the most suitable modular component may be made to the operator of the digital device.

As the disclosure describes simple and novel means of providing a resilient surface out of rigid base material, the disclosure foresees potential applications beyond skiing equipment. For example, modifications of the disclosure might be employed in place of resilient foam when such materials are used to support and cushion abrasive materials.

Such resilient arrays as are described in the disclosure can be mechanically linked to the edge or to the face of another array. External surfaces may be molded with hooks, loops, snaps, buttons, or other connectors so that parts may be joined to one another, or to external components.

In general, the disclosure's directional, self-configuring property under resistance loading may provide situational utility in gripping, clamping, clutches, or differentials, or other mechanical operations or applications.

The disclosure may be used in diverse circumstances in the practice of skiing. Children and other novices learning the practice of Alpine skiing have great difficulty even with short stretches of moderate incline. These inexperienced users can have a more positive experience through the use of the disclosure, which allows relatively effortless uphill travel, while its intrinsic properties deter frustrating, and sometimes hazardous, backward motion.

Through the disclosure, Nordic skiers are provided with a convenient means to optimize forward motion with a relative minimum to training and athletic practice. Many of the vexations of traversing terrain of intermittent incline are resolved by the disclosure's materials, which automatically adapt to the skiers' weight distribution and muscular action.

By use of the disclosure, Alpine-touring (A/T), cross-country, or telemark skiers can forego the use of fibrous climbing skins. These skiers climb can thereby ascend and descend a mountainous terrain without the need to stop and attach or remove adhesive-backed fabric materials, which are awkward to install, and whose adhesion is easily impaired by contact with loose snow.

Expert back-country skiers can tailor their equipment to extreme environments and unpredictable weather conditions, while only needing to carry an array of lightweight inserts to accommodate a vast variety of natural environments.

Ski conditions often change in the course of a day. Within the envisioned scope of the disclosure, skiers who have rented equipment can have the performance and responsiveness of their equipment, in whatever conditions prevail at the hour, modified by a nearly instantaneous exchange of modular components. Consequently, day-skiers may seek optimal adaptation of their equipment on multiple occasions on a single day while visiting a ski resort or other venue.

In each of the above circumstances, an application of the disclosure promotes both safety and enjoyment of the practice of skiing.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A ski comprising:

a ski body including a top surface, a bottom surface, a tip and a tail, the top surface of the ski body having a binding to secure a boot of a skier, the binding having a plate positioned to receive the boot of the skier, the ski body further including a kick zone in the bottom surface of the ski body, the kick zone having a region opposite the binding and the plate; and a thrust-responsive module positioned to enter within the kick zone, the thrust-responsive module including an array of teeth, each tooth being configured to move from an elevated position to a retracted position, each tooth further including a first retention feature, and a tooth array matrix formed within a plane of the kick zone, the tooth array matrix fully surrounding a perimeter of at least a subset of the array of teeth, the tooth array matrix being static relative to the array of teeth, the tooth array matrix including a plurality of second retention features configured to captively engage the first retention features of the array of teeth, wherein when the skier stops or applies rearward force, the array of teeth extends to the elevated position, and when the skier applies force on the kick zone, the array of teeth are forced to the retracted position.

2. The ski of claim 1, wherein a position of each tooth, in the elevated position, is limited by contact between the first retention feature and the second retention feature.

3. The ski of claim 2, wherein the array of teeth is formed monolithically.

4. The ski of claim 3, wherein the array of teeth is formed monolithically with the tooth array matrix.

5. The ski of claim 4, wherein the first retention features of the array of teeth are formed monolithically with the plurality of second retention features of the tooth array matrix.

6. The ski of claim 1, wherein the thrust-responsive module further includes a cover plate including a plurality of apertures and a lattice defined by the plurality of apertures, the cover plate being formed separately from the tooth array matrix, the cover plate encompassing the plurality of second retention features of the tooth array matrix.

7. The ski of claim 1, wherein the first retention features of the array of teeth and the second retention features of the tooth array matrix are dimensioned mating components configured to snap fit with one another.

8. The ski of claim 7, wherein the array of teeth is hinged to the tooth array matrix.

9. The ski of claim 1, wherein each tooth of the array of teeth is received in a recess formed in the tooth array matrix, the recess being configured to receive the tooth therein.

10. The ski of claim 9, wherein each tooth of the array of teeth and the recesses of the tooth array matrix are configured so that an external face on the tooth, when retracted, substantially occupies the same geometrical plane as the tooth array matrix.

11. The ski of claim 1, wherein each tooth of the array of teeth is held by default in the elevated position by at least one pliable feature.

12. The ski of claim 11, wherein the at least one pliable feature is a spring.

13. The ski of claim 12, wherein the spring is formed monolithically with a corresponding tooth from among the array of teeth.

14. The ski of claim 11, wherein the at least one pliable feature is composed of a resilient material.

15. The ski of claim 1, wherein the thrust-responsive module further includes a control plate, the control plate including a plurality of engagement features configured to be devised to intrude upon a free range of motion of the array of teeth, and thereby regulate the position of the teeth of the array of teeth.

16. A ski equipped to be biased to forward motion, comprising:

a ski body including a recess, the recess being formed in the bottom of the ski body;

an insert compatible with the recess in the bottom of the ski, the insert including an array of teeth formed within a plane of the ski base and pliably coupled to a commensurate tooth array matrix, the tooth array matrix being held positionally stationary relative to the ski body and remaining substantially static relative to selective movement of the array of teeth; and fastening means to interchangeably attach the insert to the recess in the ski body.

17. The ski of claim 16, wherein the array of teeth includes a plurality of teeth, each tooth including a portion configured to move from an elevated position to a retracted position, each tooth further including a first retention feature.

18. The ski of claim 17, wherein the tooth array matrix is configured to surround at least a subset of the array of teeth, the tooth array matrix being static relative to the array of teeth, the tooth array matrix including a plurality of second retention features configured to captively engage the first retention features of the array of teeth.

19. The ski of claim 18, wherein an angular position of each tooth of the array of teeth, in the elevated position, is limited by contact between the first retention feature and the second retention feature.

* * * * *